US007275860B2

(12) United States Patent
Hirano et al.

(10) Patent No.: US 7,275,860 B2
(45) Date of Patent: Oct. 2, 2007

(54) DISPLAY CORRECTING MECHANISM AND TIMEPIECE HAVING DISPLAY CORRECTING MECHANISM

(75) Inventors: Kei Hirano, Chiba (JP); Shigeo Suzuki, Chiba (JP)

(73) Assignee: Seiko Instruments Inc. (JP)

( * ) Notice: Subject to any disclaimer, the term of this patent is extended or adjusted under 35 U.S.C. 154(b) by 253 days.

(21) Appl. No.: 11/043,883

(22) Filed: Jan. 26, 2005

(65) Prior Publication Data

US 2005/0162983 A1 Jul. 28, 2005

(30) Foreign Application Priority Data

Jan. 27, 2004 (JP) ..... 2004-018503

(51) Int. Cl.
*G04B 27/04* (2006.01)

(52) U.S. Cl. ..... 368/191; 368/319

(58) Field of Classification Search ..... 368/184, 368/185, 186–195, 288, 308, 319–321
See application file for complete search history.

(56) References Cited

U.S. PATENT DOCUMENTS 792,414 A * 6/1905 Guggisberg ..... 368/193
2,633,950 A * 4/1953 Phaneuf ..... 192/41 S
3,443,375 A * 5/1969 Cielaszyk ..... 368/185
3,855,785 A * 12/1974 Ushikoshi ..... 368/36
4,363,554 A * 12/1982 Schaffner et al. ..... 368/190
4,800,545 A * 1/1989 Wuthrich et al. ..... 368/190
5,303,213 A * 4/1994 Kaelin ..... 368/185
6,179,464 B1 * 1/2001 Bettelini ..... 368/185
7,025,494 B2 * 4/2006 Oomori et al. ..... 368/190

FOREIGN PATENT DOCUMENTS

CH 607556 8/1978
JP 60027884 2/1985
JP 64000627 8/1988
JP 09061522 3/1997

* cited by examiner

*Primary Examiner*—Vit Miska
*Assistant Examiner*—Sean Kayes
(74) *Attorney, Agent, or Firm*—Adams & Wilks

(57) ABSTRACT

A timepiece has a train wheel, a display member for undergoing rotation in accordance with rotation of the train wheel, and a display correcting mechanism for correcting a display content of the display member. The display correcting mechanism has a corrector setting transmission wheel mounted for undergoing rotation, a correction transmitting spring mounted for undergoing movement in accordance with rotation of the corrector setting transmission wheel, a correcting member for undergoing operation in accordance with rotation of the corrector setting transmission wheel and movement of the correction transmitting spring to correct a display content of a display member, and a hand setting stem mounted for undergoing rotation to rotate the corrector setting transmission wheel and move the correction transmitting spring to thereby operate the correcting member to correct the display content of the display member.

9 Claims, 16 Drawing Sheets

DISPLAY CORRECTING MECHANISM AND TIMEPIECE HAVING DISPLAY CORRECTING MECHANISM

BACKGROUND OF THE INVENTION

1. Field of the Invention

The present invention relates to a timepiece having a display correcting mechanism having a mechanism for correcting the display of a calendar display or the like. Particularly, the invention relates to a timepiece having a display correcting mechanism having a calendar correcting mechanism including a spring moved cooperatively with a hand setting stem.

2. Description of the Prior Art (1) A Timepiece of a First Type of a Background Art A timepiece having a display correcting mechanism of a first type of a background art includes a hand setting stem, a calendar corrector setting transmission wheel integrated to the hand setting stem, a calendar corrector setting wheel brought in mesh with the calendar corrector setting transmission wheel and holding an eccentric pin, and a calendar correcting member frictionally engaged with the eccentric pin for correcting a date indicator or a day indicator by rotating the calendar corrector setting wheel. The calendar corrector setting transmission wheel is formed by a plastic material, arranged in a groove of a main plate and is always brought in mesh with the calendar corrector setting wheel. When the hand setting stem is disposed at a correcting position in an axial direction, a large diameter portion of the hand setting stem is brought into directly and frictionally engaged with a small diameter portion of the calendar corrector setting transmission wheel to thereby enable to transmit rotation of the hand setting stem to the calendar corrector setting wheel (refer to, for example, JP-UM-B-64-627).

(2) Timepiece of a Second Type of a Background Art

A timepiece having a display correcting mechanism of a second type of a background art is formed with a square projected portion at an outer peripheral face of a clutch wheel moved cooperatively with movement in an axial direction of a hand setting stem and rotation of the hand setting stem. A square recess portion is formed on a side of a corrector setting transmission wheel opposed to the square projected portion. When an additional function is corrected, a yoke presses the clutch wheel and the corrector setting wheel in an outer peripheral direction of a timepiece by an elastic force (refer to, for example, JP-A-9-61552).

(3) Timepiece of a Third Type of a Background Art

A calendar correcting apparatus of a timepiece of a third type of a background art includes at least one or more groove portions provided for positioning, a pinion brought in mesh with a transmitting wheel, first correcting teeth directly brought in mesh with a date indicator on an axis of a hand setting stem having a faced portion provided between the pinion and the grove portion, second correcting teeth directly or indirectly engaged with a day star wheel, a spring member provided slidably with a calendar corrector setting wheel having a projected portion engaged with the faced portion of the hand setting stem for receiving rotation of the hand setting stem and pressing the corrector setting wheel in a direction of drawing out the hand setting stem and a positioning member for rectifying a position of the calendar corrector setting wheel (refer to, for example, JP-A-60-27884).

According to the timepiece having a correcting mechanism of the first type of the background art, at each time of operating to correct, the large diameter portion (square portion) of the hand setting stem is brought in and out to and from the small diameter portion of the calendar corrector setting transmission wheel repeatedly by a number of times and therefore, the small diameter portion of the calendar corrector setting transmission wheel is widened, and there poses a problem that rotation of the hand setting stem cannot sufficiently be transmitted to the calendar corrector setting transmission wheel. Further, according to the timepiece having a correcting mechanism of the second type of the background art, there poses a problem that a structure of the yoke becomes complicated, further, it is difficult to provide a winding pinion constituting a hand winding mechanism moved cooperatively with the clutch wheel. According to the calendar correcting apparatus of the timepiece of the third type of the background art, there poses a problem that a structure of the calendar corrector setting wheel becomes complicated, and there are needed the spring member for pressing the corrector setting wheel in the direction of drawing out the hand setting stem and the positioning member for rectifying the position of the calendar corrector setting wheel.

It is an object of the invention to promote a durability of a part constituting a correcting mechanism in a timepiece having a display correcting mechanism, particularly, a timepiece having a calendar correcting mechanism. It is another object of the invention to reduce a number of parts constituting a calendar correcting mechanism by simplifying structures of parts constituting the calendar correcting mechanism in a timepiece having a display correcting mechanism.

SUMMARY OF THE INVENTION

The invention is constituted to include, in a timepiece having a display correcting mechanism having a mechanism of correcting a display content displayed by a display member, a display member rotated based on rotation of a train wheel of the timepiece for displaying information, a hand setting stem for correcting the display content of the display member, a corrector setting transmission wheel arranged coaxially with the hand setting stem, a correction transmitting spring formed by an elastic material and moved cooperatively with the corrector setting transmission wheel, and a correcting member operated based on rotation of the corrector setting transmission wheel and the correction transmitting spring for correcting the display content of the display member. A timepiece having a display correcting mechanism of the invention is characterized in being constituted to be able to correct the display content displayed by the display member by operating the correcting member by integrally rotating the corrector setting transmission wheel and the correction transmitting spring by rotating the hand setting stem in a state of setting the hand setting stem at a position for correcting the display content of the display member. By the constitution, a square portion of the hand setting stem is not brought in and out to and from a hole portion of the corrector setting wheel formed by a plastic and therefore, a durability of a part constituting the correcting mechanism can be promoted.

The display member is, for example, a date indicator, a day display wheel, a day indicator, a 24 hour display wheel, a month display wheel, a lunar age display wheel or the like. Further, the invention is widely applicable to various timepieces having display correcting mechanisms having an hour correcting mechanism (time difference correcting mechanism) and the like. According to the timepiece having the display correcting mechanism of the invention, it is preferable that a key groove is provided at the hand setting stem, a key portion is provided at the correction transmitting spring, in a state of setting the hand setting stem at the position for correcting the display content of the display member (for example, 1 stage), the corrector setting transmission wheel and the correction transmitting spring are constituted to rotate integrally by rotating the hand setting stem by bringing the key portion into the key groove, in a state of setting the hand setting stem at a position other than the position for correcting the display content of the display member (for example, 0 stage and 2 stage), the key portion is not brought into the key groove and the corrector setting transmission wheel and the correction transmitting spring are constituted not to be rotated even when the hand setting stem is rotated. According to such a correcting mechanism, a structure of a constituent part is simple and it is easy to cooperatively move a winding pinion and a clutch wheel.

Further, according to the timepiece having the display correcting mechanism of the invention, it is preferable to arrange a plurality of the key grooves at equal intervals at an outer peripheral portion of the hand setting stem. Further, according to the timepiece having the display correcting mechanism of the invention, it is preferable that the correction transmitting spring includes a base portion formed in a C-like shape, a positioning portion formed orthogonally to one end portion of the base portion, and a key portion provided at a front end of the positioning portion. Further, according to the timepiece having the display correcting mechanism of the invention, it is preferable that the correction transmitting wheel includes a main body cylinder portion in a ring-like shape, a plurality of tooth portions, a center hole provided at the main body cylinder portion, a ring-like band portion formed at one face of the main body cylinder portion and a groove portion formed at the ring-like band portion. The corrector setting transmission wheel can be formed by a metal and can be formed also by a plastic.

Further, it is preferable that the timepiece having the display correcting mechanism of the invention further includes a second corrector setting transmission wheel brought in mesh with the corrector setting wheel and the second corrector setting transmission wheel is arranged to overlap a center axis line of the hand setting stem. Further, according to the timepiece having the display correcting mechanism of the invention, it is preferable that the display member is a date indicator and a rotational center of the second corrector setting transmission wheel is arranged on an outer side of a tooth tip circle of the date indicator. Further, it is preferable that the timepiece having the display correcting mechanism of the invention further includes an indicator for displaying second information different from the display content of the display member and a rotational center of the indicator is arranged on an inner side of the tooth tip circle of the date indicator and the indicator is arrange to overlap the center axis line of the hand setting stem. By the constitution, the display mechanism and the display correcting mechanism can effectively be arranged in a small and thin movement.

BRIEF DESCRIPTION OF THE DRAWINGS

A preferred form of the present invention is illustrated in the accompanying drawings in which.

DETAILED DESCRIPTION OF THE PREFERRED EMBODIMENTS

Figure 1:
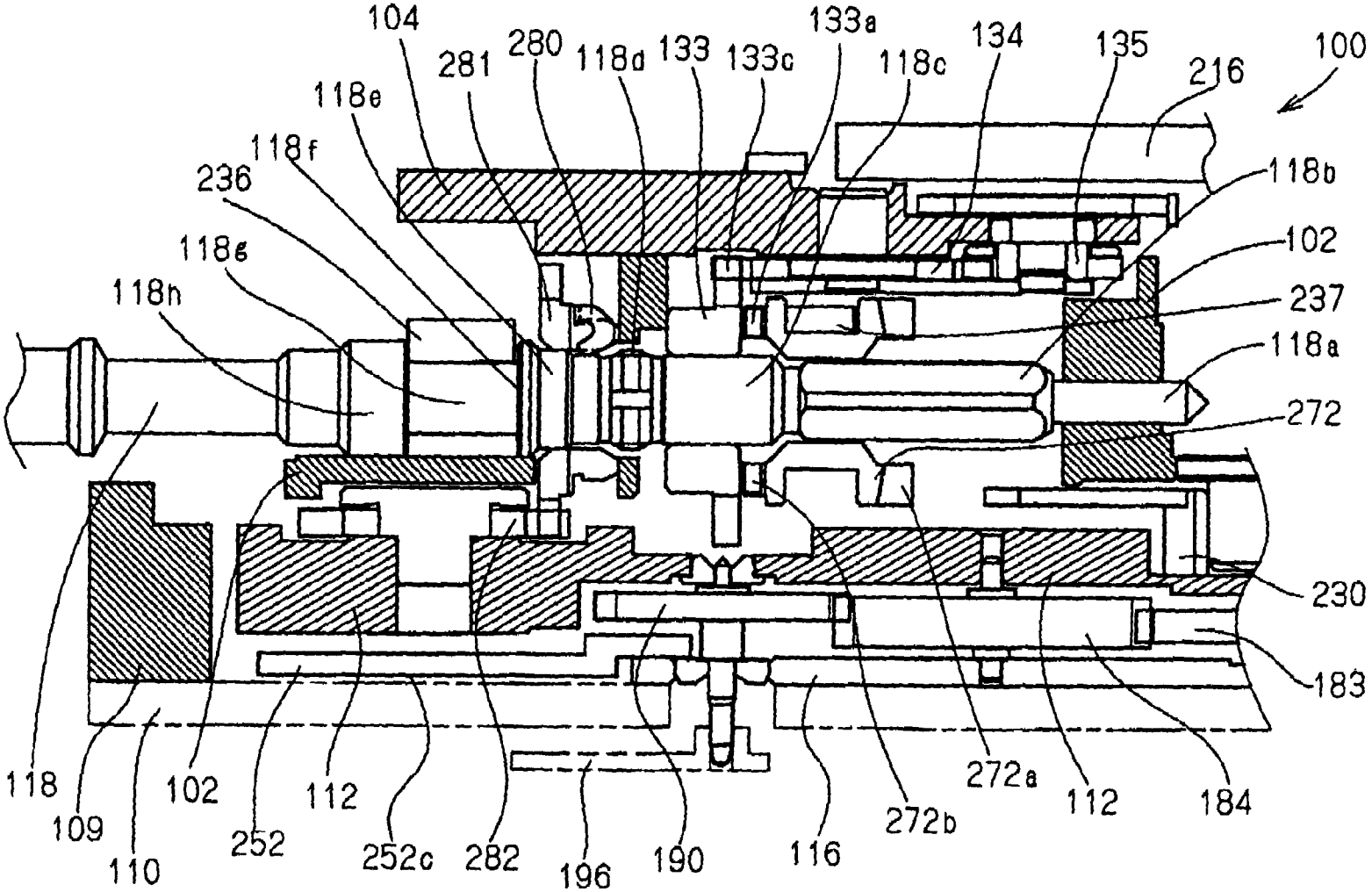
FIG. 1 is a partial sectional view showing a portion of a hand setting stem in a state of setting the hand setting stem to 0 stage according to a first embodiment of a timepiece having a display correcting mechanism of the invention.

An embodiment of a timepiece having a display correcting mechanism of the invention will be explained in reference to the drawings as follows. Although according to the embodiment of the timepiece of the invention explained below, a description has been given of a constitution of a timepiece having a display correcting mechanism including a calendar correcting mechanism for correcting a date indicator, the invention is also widely applicable to various timepieces having a display correcting mechanism, including mechanisms for correcting a day display wheel, a day indicator, a 24 hour display wheel, a month display wheel, a lunar age display wheel and the like, an hour correcting mechanism (time difference correcting mechanism) and the like. Further, although according to the embodiment of the timepiece of the invention explained below, a description is given to a constitution of a mechanical timepiece having an automatic winding mechanism, the invention is widely applicable to various timepieces having display correcting mechanisms of an electric timepiece, an electronic timepiece and the like driven by a battery, a direct current power source, an alternating current power source or the like. Further, although according to the embodiment of the timepiece of the invention explained below, a description is given to a timepiece having a display correcting mechanism having a mechanism of correcting a date indicator, the invention is widely applicable to a timepiece having a correcting mechanism including various display members of a display wheel attached with an indicator hand or the like.

(1) First Embodiment

(1-1) Total Constitution of a Movement

First, a first embodiment of a timepiece having a display correcting mechanism of the invention will be explained. The first embodiment relates to a timepiece having a calendar correcting mechanism. In reference to FIG. 1 through FIG. 4, a timepiece having a calendar correcting mechanism of the invention includes a movement 100. "Movement" indicates a machine body of a timepiece including a drive portion. Further, "complete" indicates a finished body of a timepiece in which a movement of a timepiece is attached with a dial, an indicator (hour hand, minute hand, second hand or the like), a crown or the like to contain in a timepiece case (timepiece atmosphere). The movement 100 includes a main plate 102, a second main plate 112, and a date indicator maintaining plate 116. In the movement 100, "top side" indicates a side in two faces of the main plate 102 remote from glass of the timepiece case, that is, "case back side". In the movement 100, "back side" indicates a side of the two faces of the main plate 102 proximate to the glass of the timepiece case, that is, "dial side". The movement 100 includes a train wheel bridge 103, a first bridge 104, a second bridge 105, a pallet fork bridge 106 and a balance bridge 107. The second main plate 112 and the date indicator maintaining plate 116 are arranged on the back side of the main plate 102. A dial 110 is arranged on a side of the glass of the second main plate 112. The dial 110 is integrated to the main plate 102 via a dial support ring 109. A hand setting stem 118 is integrated to the main plate 102 rotatably and movably in an axis line direction.

The top side of the movement 100 is arranged with a top train wheel, an escaping mechanism, a speed control mechanism, an automatic winding mechanism, a hand winding mechanism and a switching apparatus. Alternatively, the switching apparatus may be arranged on the back side of the movement 100, and the hand winding mechanism may be arranged on the top side of the movement 100 and the automatic winding mechanism may be omitted. The back side of the movement 100 is arranged with a back train wheel, a date display mechanism, a date correcting mechanism. When needed, the back side of the movement 100 may be arranged with any of a day display mechanism, a day correcting mechanism, a 24 hour display mechanism, a month display mechanism, a lunar age display mechanism, and a mainspring winding state display mechanism. The top train wheel is rotatably supported by the main plate 102, the first bridge 104 and the second bridge 105. The back train wheel is rotatably supported by the main plate 102, the second main plate 112, and the date indicator maintaining plate 116. The back train wheel is rotatably supported by the main plate 102, the second main plate 112, and the date indicator maintaining plate 116.

(1-2) Constitution of a Top Train Wheel

Next, a constitution of a top train wheel will be explained. In reference to FIG. 1 through FIG. 3, a barrel complete 120 is rotatably supported by the first bridge 104 and the main plate 102. The barrel complete 120 includes a mainspring (not illustrated). The mainspring constitutes a power source of a mechanical timepiece. By winding back (releasing) the mainspring, a barrel gear of the barrel complete 120 is rotated in one direction to display time information of an indicator (hour hand, minute hand, second hand or the like) via rotation of the top train wheel and the back train wheel. Rotation of the barrel gear rotated by power of the mainspring is controlled by a speed control apparatus and an escaping apparatus. The speed control apparatus includes a balance with hairspring 142. The escaping apparatus includes a pallet fork 144 and an escape wheel & pinion 146. The balance with hairspring 142 is rotatably supported by the balance bridge 107 and the main plate 102. The pallet fork 144 is rotatably supported by the pallet fork bridge 106 and the main plate 102. The escape wheel & pinion 146 is rotatably supported by the first bridge 104 and the main plate 102. A center wheel & pinion 122 (refer to FIG. 4) is constituted to be rotated by one rotation per hour by rotation of the barrel gear. The center wheel & pinion 122 is rotatably supported by the second bridge 105 and the main plate 102. A third wheel & pinion 124 is constituted to rotate by rotation of the center wheel & pinion 122.

The third wheel & pinion 124 is rotatably supported by the first bridge 104 and the main plate 102. A second wheel & pinion 126 is constituted to be rotated by one rotation per minute by rotation of the third wheel & pinion 124. The second wheel & pinion 126 is rotatably supported by the first bridge 104 and the main plate 102. A rotational speed of the second wheel & pinion 126 is constituted to be controlled by the escape wheel & pinion 146. A rotational speed of the escape wheel & pinion 146 is constituted to be controlled by the pallet fork 144. A pivoting movement of the pallet fork 144 is constituted to be controlled by the balance with hairspring 142. A balance rectifying lever 140 is provided to rectify operation of the balance with hairspring 142. That is, in a state of setting the hand setting stem 118 to 2 stage, the balance rectifying lever 140 is constituted to be brought into contact with a balance ring 142*c* of the balance with hairspring 142 to be able to stop rotation of the balance ring 142*c*. The top train wheel includes the center wheel & pinion 122, the third wheel & pinion 124 and the second wheel & pinion 126. A minute hand (not illustrated) attached to an hour pinion (not illustrated) of the center wheel & pinion 122 is constituted to display "minute". A second hand (not illustrated) attached to the second wheel & pinion 126 is constituted to display "second". A rotational center of the second wheel & pinion 126 and a rotational center of the center wheel & pinion 122 are constituted to be disposed at the same position.

A square hole portion of the ratchet wheel 130 is integrated to a square shaft portion provided at an upper portion of a barrel stem of a barrel complete 120 (side where the first bridge 104 is present). By a square hole stop screw 132, the ratchet wheel 130 is supported to be rotated integrally with the barrel stem 120*c*. The ratchet wheel 130 can be rotated only in a direction the same as a direction of rotating the barrel complete 120. A click 131 constituting a member for rectifying rotation of the ratchet wheel is provided at the first bridge 104 for rectifying rotation of the ratchet wheel 130 only in one direction. By the click 131, the ratchet wheel 130 can be hampered from rotating in a direction opposed to the direction of rotating the barrel complete 120. The hand winding mechanism includes a clutch wheel 272, a winding pinion 133, a crown wheel 134 and a crown transmission wheel 135. The crown wheel 134 is rotatably supported by a back face of the first bridge 104. The crown transmission wheel 135 is rotatably supported by the back face of the first bridge 104. The winding pinion 133 is constituted to rotate by rotation of the crutch wheel 272 in one direction. The crown transmission wheel 135 is constituted to rotate by rotation of the winding pinion 133 via the crown wheel 134. The ratchet wheel 130 is constituted to rotate in the clockwise direction by rotation of the crown transmission wheel 135. The mainspring is constituted to be able to be wound by rotating the ratchet wheel 130.

(1-3) Constitution of an Automatic Winding Mechanism

Figure 2:
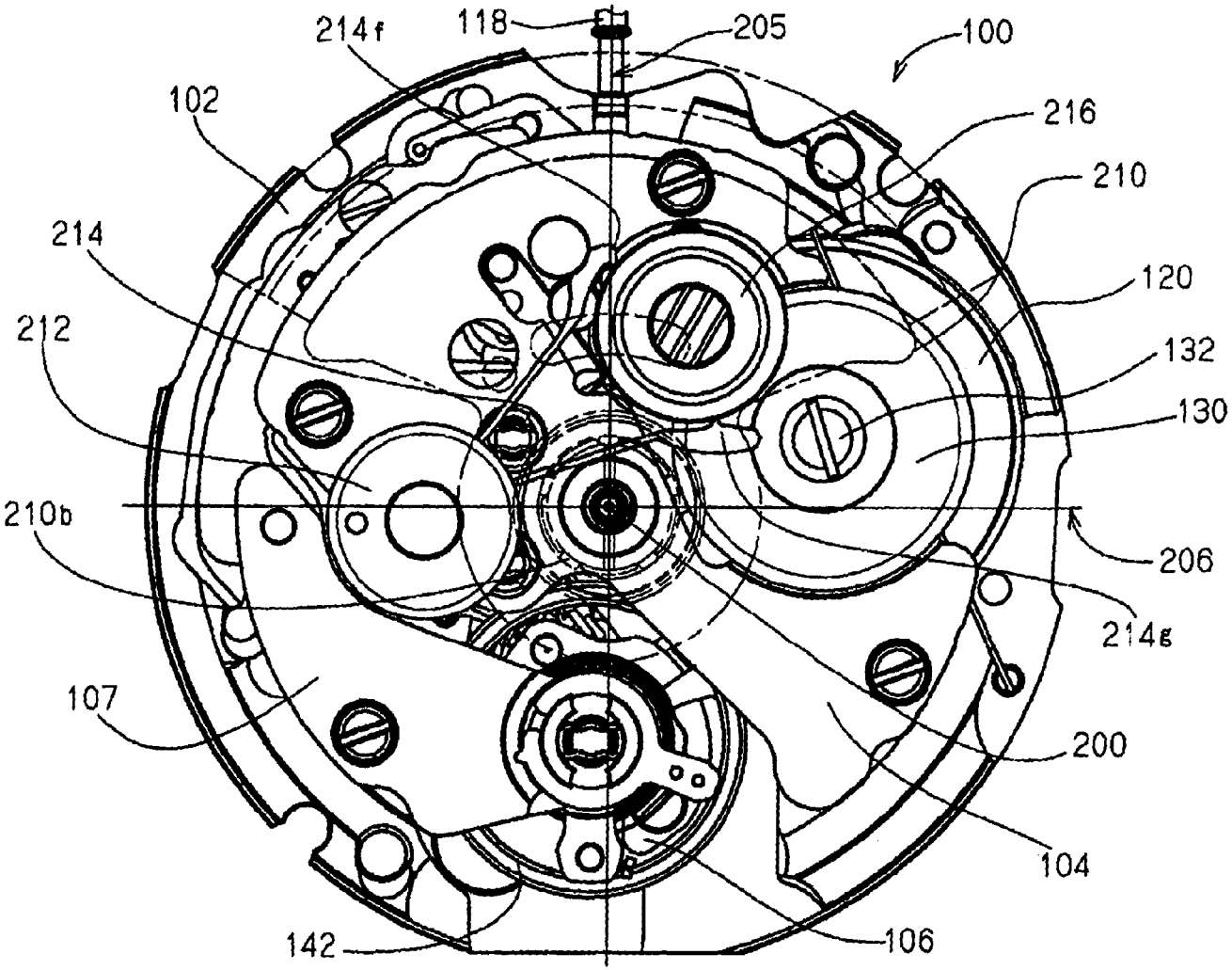
FIG. 2 is a plane view (top plane view) showing a state of viewing a movement from a case back side according to the first embodiment of the timepiece having the display correcting mechanism of the invention.
Figure 3:
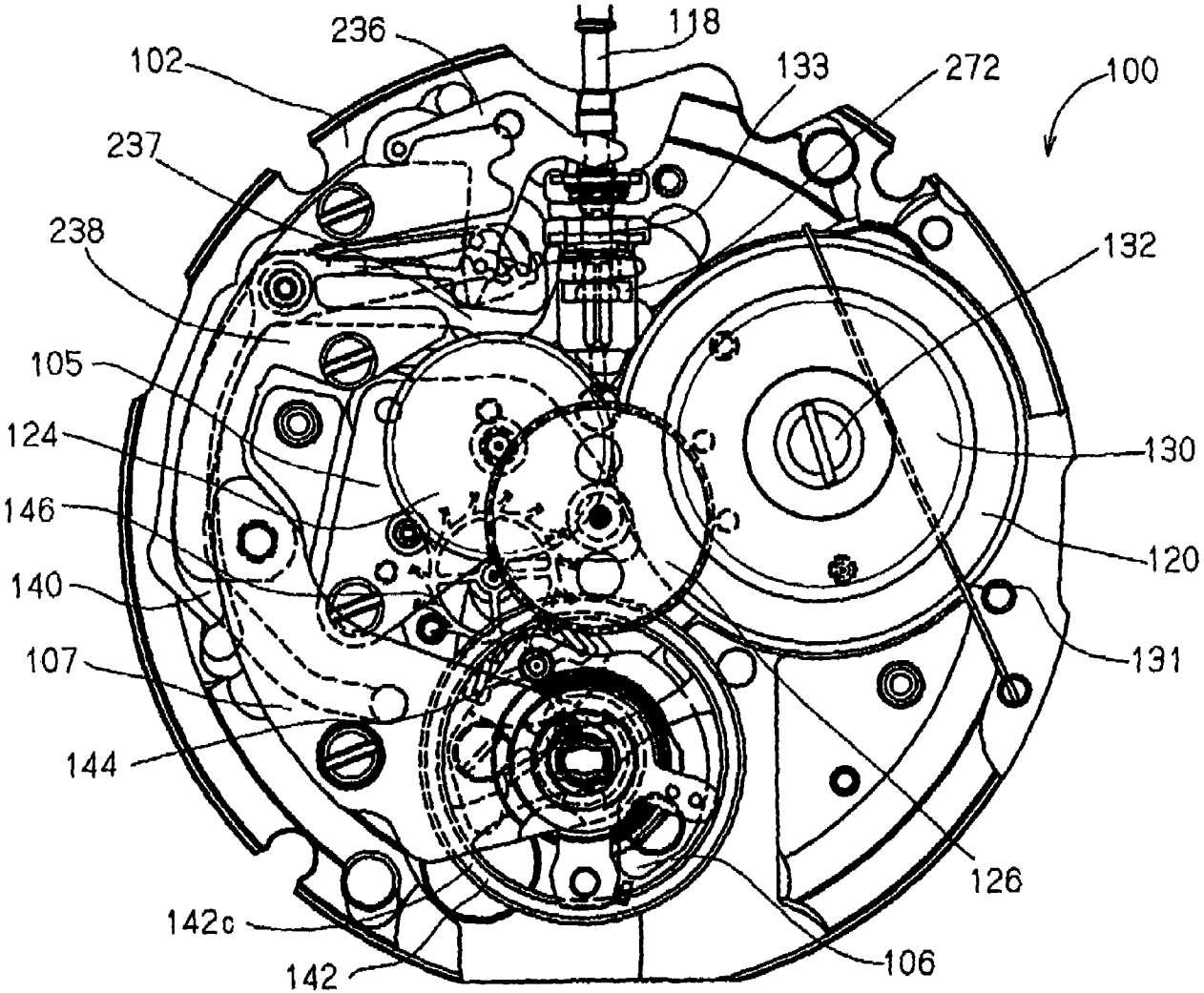
FIG. 3 is a plane view (top plane view) showing a state of viewing the movement from the case back side by removing a first bridge according to the first embodiment of the timepiece having the display correcting mechanism of the invention.

Next, a constitution of an automatic winding mechanism will be explained. In FIG. 2, an automatic winding mechanism for winding up the mainspring is provided on the top side of the movement 100. The automatic winding mechanism includes an oscillating weight 210, a first transmission wheel 212, a pawl lever 214, and a second transmission wheel 216. The oscillating weight 210 is rotatably integrated to the first bridge 104 via a ball bearing 210*b*. The first transmission wheel 212 is rotatably supported by the first bridge 104 and the main plate 102. A gear portion of the first transmission wheel 212 is constituted to be brought in mesh with an oscillating weight pinion 210*c* of the oscillating weight 210. A hole (not illustrated) of a base portion of the pawl lever 214 is rotatably integrated to an eccentric cam portion (not illustrated) of the first transmission wheel 212. The pawl lever 214 includes two pawl portions, that is, a pull pawl 214*f* and a push pawl 214*g*. The second transmission wheel 216 is rotatably supported by the first bridge 104. The pull pawl 214*f* and the push pawl 214*g* of the pawl lever 214 are constituted to be brought into contact with ratchet teeth (not illustrated) of the second transmission wheel 216. The pawl lever 214 is constituted to operate by rotating the first transmission wheel 212 when the oscillating weight 210 is rotated. The pull pawl 214*f* of the pawl lever 214 is constituted to be able to rotate the second transmission wheel 216 only in one direction (counterclockwise direction in FIG. 2). The push pawl 214*g* of the pawl lever 214 is constituted to be able to rotate the second transmission wheel 216 only in one direction (counterclockwise direction in FIG. 2). Therefore, when the oscillating weight 210 is rotated, the pawl lever 214 is operated and the ratchet wheel 130 is constituted to rotate in the clockwise direction based on the second transmission wheel 216. As a result, when the oscillating weight 210 is rotated, the mainspring can be wound up by operating the automatic winding mechanism.

(1-4) Constitution of a Back Train Wheel

Next, a constitution of a back train wheel will be explained. In reference to FIG. 4, the back train wheel includes a minute-wheel 230 and an hour wheel 232. The minute wheel 230 is rotatably supported by the main plate 102. The hour wheel 230 is constituted to rotate by rotation of the center wheel & pinion 122. The hour wheel 232 is constituted to be rotated by one rotation per 12 hours by rotation of the minute wheel 230. An hour hand (not illustrated) attached to the hour wheel 232 indicates "hour". A rotational center of the hour wheel 232 and a rotational center of the second wheel & pinion 122 are constituted to be disposed at the same position. It is preferable that a rotational center of the minute wheel 230 is arranged on a main plate reference vertical axis line 205.

(1-5) Constitution of a Switching Mechanism

Next, a constitution of a switching mechanism will be explained. The timepiece of the invention is provided with the switching mechanism and a time setting mechanism in order to set time of the timepiece. In reference to FIG. 1 and FIG. 3, the switching mechanism is constituted to include a setting lever 236, a yoke 237 and a yoke holder 238. The setting lever 236, the yoke 237 and the yoke holder 238 are operably supported by the main plate 102. The time setting mechanism includes the hand setting stem 118 and a clutch wheel 272. The hand setting stem 118 includes a front end shaft portion 118*a*, a square shaft portion 118*b*, a winding pinion guide portion 118*c*, a correction transmitting portion 118*d*, a first correction transmission wheel guide portion 118*e*, a setting lever inner wall portion 118*f*, a setting lever receiving portion 118*g*, a setting lever outer wall portion 118*h* and the like formed in this order from a front end portion to an outer portion. It is preferable that a portion of the correction transmitting portion 118*d* of the hand setting stem 118 in a direction of an inner side of the movement 100 is provided with an inner side inclined face 118*m*. It is preferable that a portion of the correction transmitting portion 118*d* of the hand setting stem 118 in a direction of an outer side of the movement 100 is provided with an outer side inclined face 118*n*. The front end shaft portion 118*a* of the hand setting stem 118 is rotatably supported by a hand setting stem front end hole of the main plate 102.

The square hole portion of the clutch wheel 272 is integrated to the square shaft portion 118*b* of the hand setting stem 118. A portion of the setting lever 236 brought into contact with the hand setting stem is disposed between the setting lever inner wall portion 118*e* and the setting lever outer wall portion 118*g* of the hand setting stem 118. A position of the hand setting stem 118 in a direction along the center axis line of the hand setting stem 118 is determined by the switching apparatus (setting lever, yoke holder or the like). A position of the clutch wheel 272 in a direction along the center axis line of the hand setting stem 118 is determined by the switching apparatus (setting lever, yoke, yoke holder and the like). The clutch wheel 272 is provided with A tooth 272*a* disposed on a side proximate to a center portion of the movement 100 and B tooth 272*b* disposed on a side proximate to an outer shape portion of the movement 100. The B tooth 272*b* of the clutch wheel 272 is constituted by a ratchet gear. A center hole portion of the winding pinion 133 is rotatably integrated by the winding pinion guide portion 118*c* of the hand setting stem 118. The winding pinion 133 includes a winding pinion small gear 133*b* constituted to be able to be brought in mesh with the B tooth 272*b* of the clutch wheel 272 and a winding pinion large gear 133*c* constituted to be able to be brought in mesh with a gear portion of the crown wheel 134. The winding pinion small gear 133*b* is constituted by a ratchet gear. Operation of the balance rectifying lever 140 is controlled by rotation of the setting lever 236.

In a state of setting the hand setting lever 118 to 0 stage and a state of setting the hand setting stem 118 to 1 stage, the A tooth 272*a* of the clutch wheel 272 is constituted not to be brought in mesh with a gear portion of the minute wheel 230. In a state of setting the hand setting stem 118 to stage, the B tooth 272*b* of the clutch wheel 272 is constituted to be brought in mesh with the small gear 133*a* of the winding pinion 133. In a state of setting the hand setting stem 118 to 2 stage, the A tooth 272*a* of the clutch wheel 272 is constituted to be brought in mesh with the gear portion of the minute wheel 230. In the state of setting the hand setting stem 118 to 2 stage, the B tooth 272*b* of the clutch wheel 272 is constituted not to be brought in mesh with the small gear 133*a* of the winding pinion 133. In the state of setting the hand setting stem 118 to 0 stage, when the hand setting stem 118 is rotated in one direction, the mainspring is constituted to be able to be wound up by rotating the clutch wheel 272 along with the hand setting stem 118, and rotating the ratchet wheel 118 via rotation of the winding pinion 133, the crown wheel 134 and the crown transmission wheel 135. In the state of setting the hand setting stem 118 to 0 stage, when the hand setting stem 118 is rotated in other direction, although the clutch wheel 272 is rotated along with the hand setting stem 118, the winding pinion 133 is constituted not to be rotated.

(1-6) Constitution of a Date Indicator Feeding Mechanism

Next, a constitution of a date indicator feeding mechanism will be explained. In reference to FIG. 1 and FIG. 4, according to a timepiece having calendar, the date indicator feeding mechanism is constituted to operate based on rotation of the back train wheel. The date indicator feeding mechanism includes a date indicator driving wheel 250, an intermediate date indicator driving wheel 251 and a date indicator 252. The intermediate date indicator driving wheel 251 is constituted to rotate by rotation of the hour wheel 232. The intermediate date indicator driving wheel 250 is constituted to rotate by rotation of the intermediate date indicator driving wheel 251. The date indicator 252 is constituted to rotate by (1/31) once per day by a date feeding claw 250*b* provided at the date indicator driving wheel 250. The date indicator 252 is constituted to be rotated by one rotation per 31 days. A position in a direction of rotating the date indicator 252 is rectified by a date jumper 253. Date characters (not illustrated) of from "1" to "31" provided at the date indicator 252 are constituted to display "date" from a window (not illustrated) of the dial 110. As a modified example, according to a constitution of providing a day indicator feeding mechanism, a day indicator can be constituted to rotate by (1/7) once per day by a day feeding claw (not illustrated) provided at the date indicator. The day indicator is constituted to rotate once per 7 days. A position in a rotational direction of the day indicator is rectified by a day jumper (not illustrated). A character (not illustrated) indicating day of week provided at the day indicator is constituted to display "day" from a window (not illustrated) of the dial 110.

(1-7) Constitution of Date Correcting Mechanism

Next, a constitution of a date correcting mechanism will be explained. In reference to FIG. 1 and FIG. 4, in the timepiece having the calendar correcting mechanism of the invention, the back side of the movement 100 is provided with a date correcting mechanism for correcting display of date by the date indicator 252 from the window of the dial 110. The date correcting mechanism is constituted by a first corrector setting transmission wheel 281, a second corrector setting transmission wheel 282, a third corrector setting transmission wheel 283, a fourth corrector setting transmission wheel 284, a fifth corrector setting transmission wheel 258, and a date corrector setting wheel 259. The second corrector setting transmission wheel 282 is rotatably supported by the second main plate 112. In a state of setting the hand setting stem 118 to 0 stage, the first corrector setting transmission wheel 281 is rotatably supported by a first corrector setting transmission wheel guide portion 118*e* of the hand setting stem 118. That is, the first corrector setting transmission wheel 281 and the hand setting stem 118 are arranged to be coaxial to each other.

A rotational center of the second corrector setting transmission wheel 282 is arranged on an outer side of a tooth tip circle of the date indicator 252. According to the embodiment of the invention, it is preferable to arrange the second corrector setting transmission wheel 282 to overlap the center axis line of the hand setting stem 118. It is further preferable to arrange the rotational center of the second corrector setting transmission wheel 282 on the center axis line of the hand setting stem 118 at a position overlapping a date display face 252*c* of the date indicator 252. A rotational center of the second corrector setting transmission wheel 282 is disposed on an outer side of a position of arranging the first corrector setting transmission wheel 281. The third corrector setting transmission wheel 283 is rotatably supported by the second main plate 112. It is preferable to arrange a rotational center of the third corrector setting transmission wheel 283 at a position of overlapping the date display face 252*c* of the date indicator 252. The fourth corrector setting transmission wheel 284 is rotatably supported by the second main plate 112. It is preferable to arrange a rotational center of the fourth corrector setting transmission wheel 284 at a position of overlapping the date display face 252*c* of the date indicator 252. The fifth corrector setting transmission wheel 258 is rotatably supported by the second main plate 112. A rotational center of the fifth corrector setting transmission wheel 258 is arranged on an inner side of the tooth tip circle of the date indicator 252. A shaft portion (not illustrated) of the corrector setting transmission wheel 259 is integrated to a fork portion of a pivoting lever 257 rotatably provided to a shaft portion (not illustrated) of the fifth corrector setting transmission wheel 258. The corrector setting transmission wheel 259 is constituted to be able to be rotated at a position of being pivoted to stop by an elastic force directed to an inner side of the fork portion. The corrector setting transmission wheel 259 is pivoted relative to the second main plate 112 by a constant angle and is rotatably supported thereby at a pivoted position. A rotational center of the corrector setting transmission wheel 259 is arranged on the inner side of the tooth tip circle of the date indicator 252.

Figure 5:
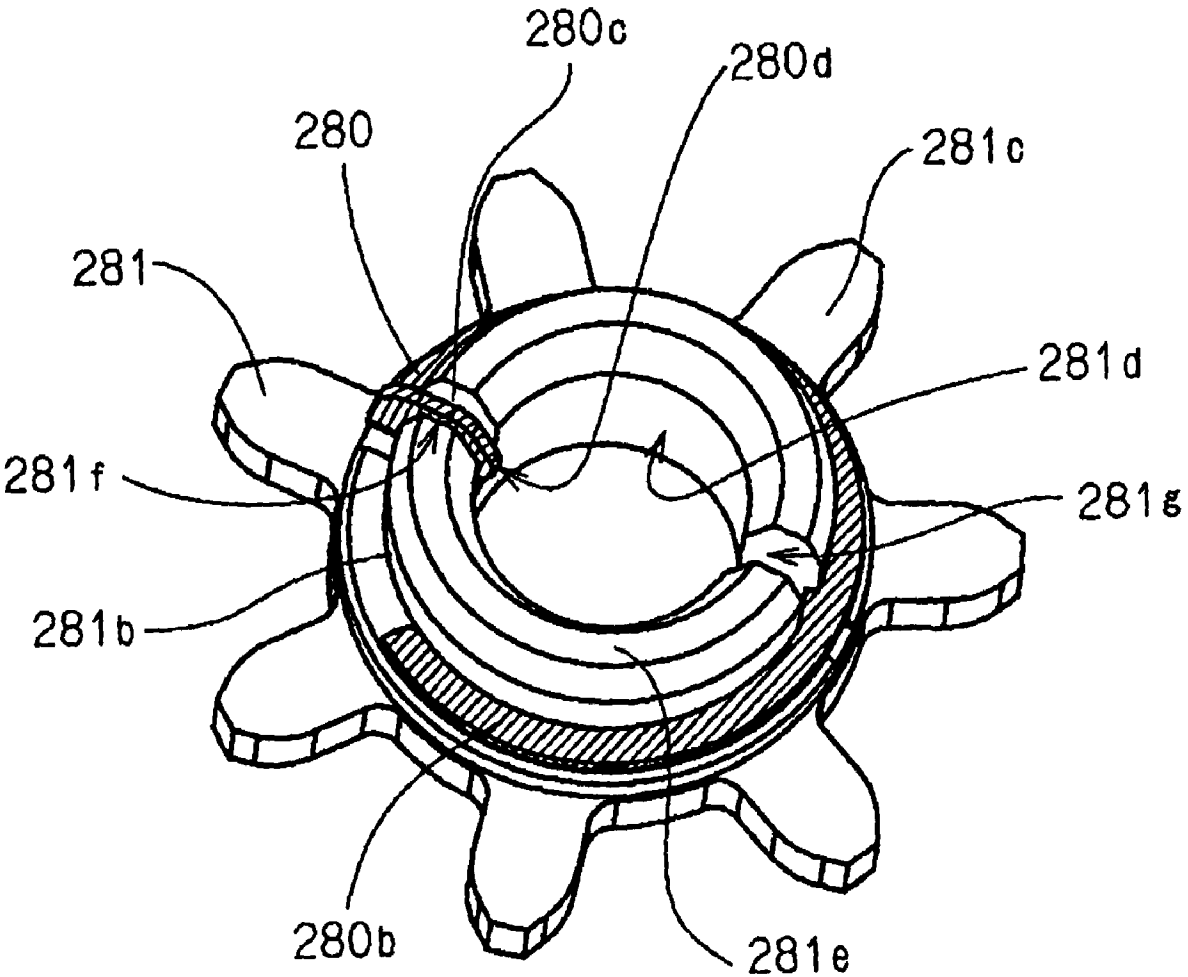
FIG. 5 is a perspective view showing a calendar corrector setting transmission wheel attached with a calendar correcting transmission spring according to the first embodiment of the timepiece having the display correcting mechanism of the invention.

In reference to FIG. 5, the first corrector setting transmission wheel 281 includes a ring-like main body cylinder portion 281*b* and a plurality of tooth portions 281*c*. FIG. 5 shows seven of the tooth portions 281*c* as an example. The first corrector setting transmission wheel 281 can be formed by a metal or can be formed by a plastic. The main body cylinder portion 281*b* includes a center hole 281*d*, a ring-like band portion 281*e* formed a tone face of the main body cylinder portion 281*b*, and one or more of groove portions 281*f*, 281*g* formed at the ring-like band portion 281*e*. Although FIG. 5 shows the two groove portions 281*f* and 281*g* as an example, a number of the groove portions may be one or may be two or more. When a plurality of the groove portions are provided, it is preferable that the plurality of groove portions are arranged at equal intervals (angular intervals constituting an equal angle) at the ring-like band portion 281*e*. It is preferable that the ring-like band portion 281*e* is formed at a face of the main body cylinder portion 281*b* on a side arranged on the inner side of the movement 100. It is preferable that the groove portions 281*f* and 281*g* are formed from a center axis line of the main body cylinder portion 281*b* in radial directions.

Figure 6:
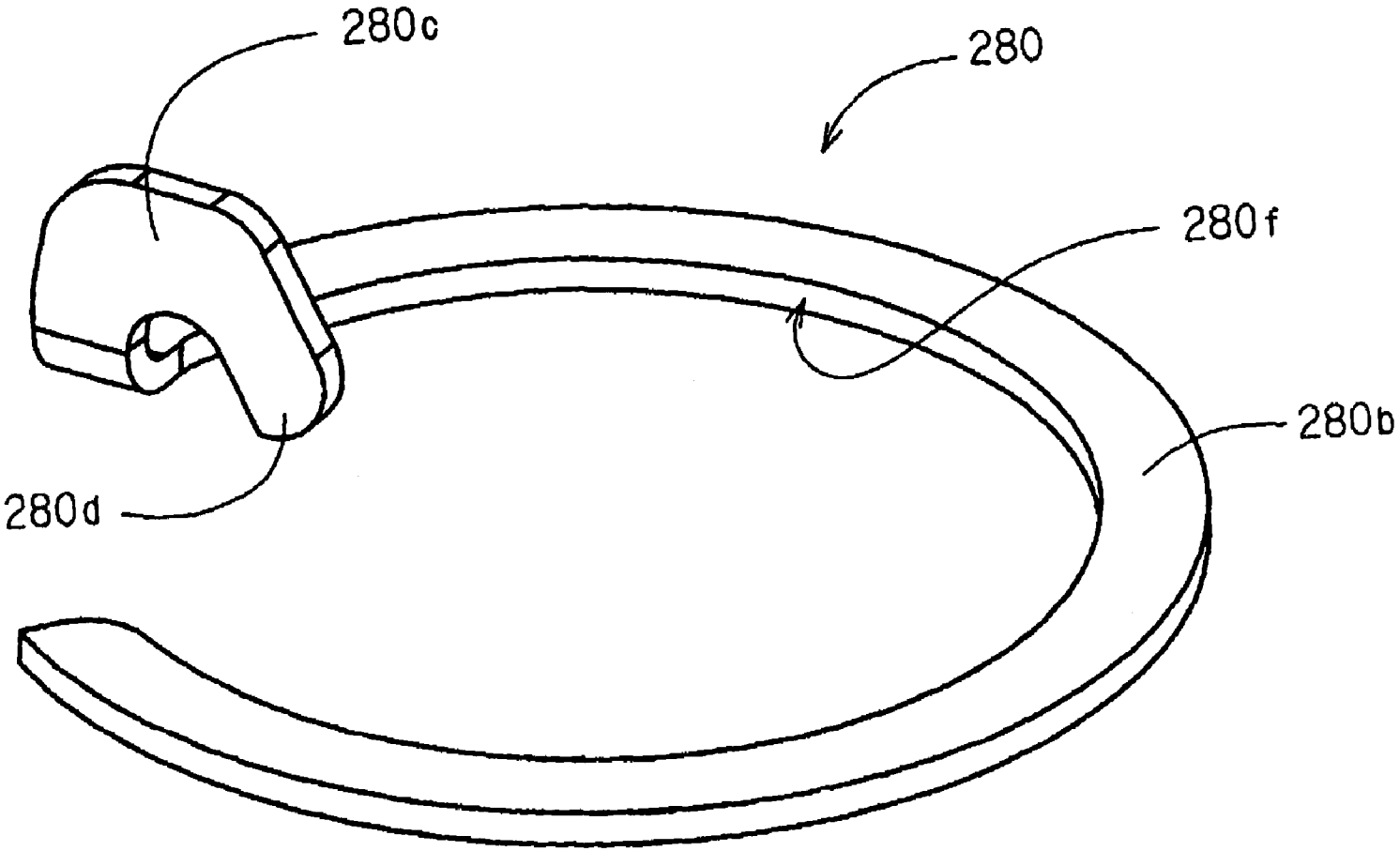
FIG. 6 is a perspective view showing a calendar correcting transmission spring according to the first embodiment of the timepiece having the display correcting mechanism of the invention.

In reference to FIG. 5 and FIG. 6, a correction transmitting spring 280 includes a base portion 280*b* formed substantially in C-like shape, a positioning portion 280*c* formed orthogonally to one end portion of the base portion 280*b*, and a key portion 280*d* provided at a front end of the positioning portion 280*c*. It is preferable that an opening angle of the base portion 280*b* is from 190 degrees to 350 degrees. It is further preferable that the opening angle of the base portion 280*b* is from 240 degrees to 320 degrees. The correction transmitting spring 280 is formed by an elastic material of stainless steel or the like. The base portion 280*b* includes a base inner diameter portion 280*f* in a circular shape by forming the base portion 280*b* in the C-like shape, the base portion 280*b* can be widened to an outer side in a radius direction. The base inner diameter portion 280*f* of the correction transmitting spring 280 is fitted to the ring-like band portion 281*e* of the first corrector setting transmission wheel 281. At this occasion, the positioning portion 280*c* of the correction transmitting spring 280 is fitted into the one groove portion 281*f* of the first correction transmitting wheel 281. Or, the positioning portion 280*c* of the correction transmitting spring 280 can also be fitted into the other groove portion 281*g*. Under the state, the key portion 280*d* of the correction transmitting spring 280 is constituted to project to an inner side of the center hole 281*d* of the first corrector setting transmission wheel 281. The base portion 280*b* of the correction transmitting spring 280 is elastically deformable and therefore, in the state shown in FIG. 5, when a force directed to outer side is exerted to the key portion 280*d* of the correction transmitting spring 280, the key portion 280*d* can be widened to the outer side in the radius direction. Further, when the force is stopped to be exerted to the key portion 280*d* of the correction transmitting spring 280, since the base portion 280*b* of the correction transmitting spring 280 is elastically deformable, the key portion 280*d* is constituted to be able to return to an initial position shown in FIG. 5.

Figure 7:
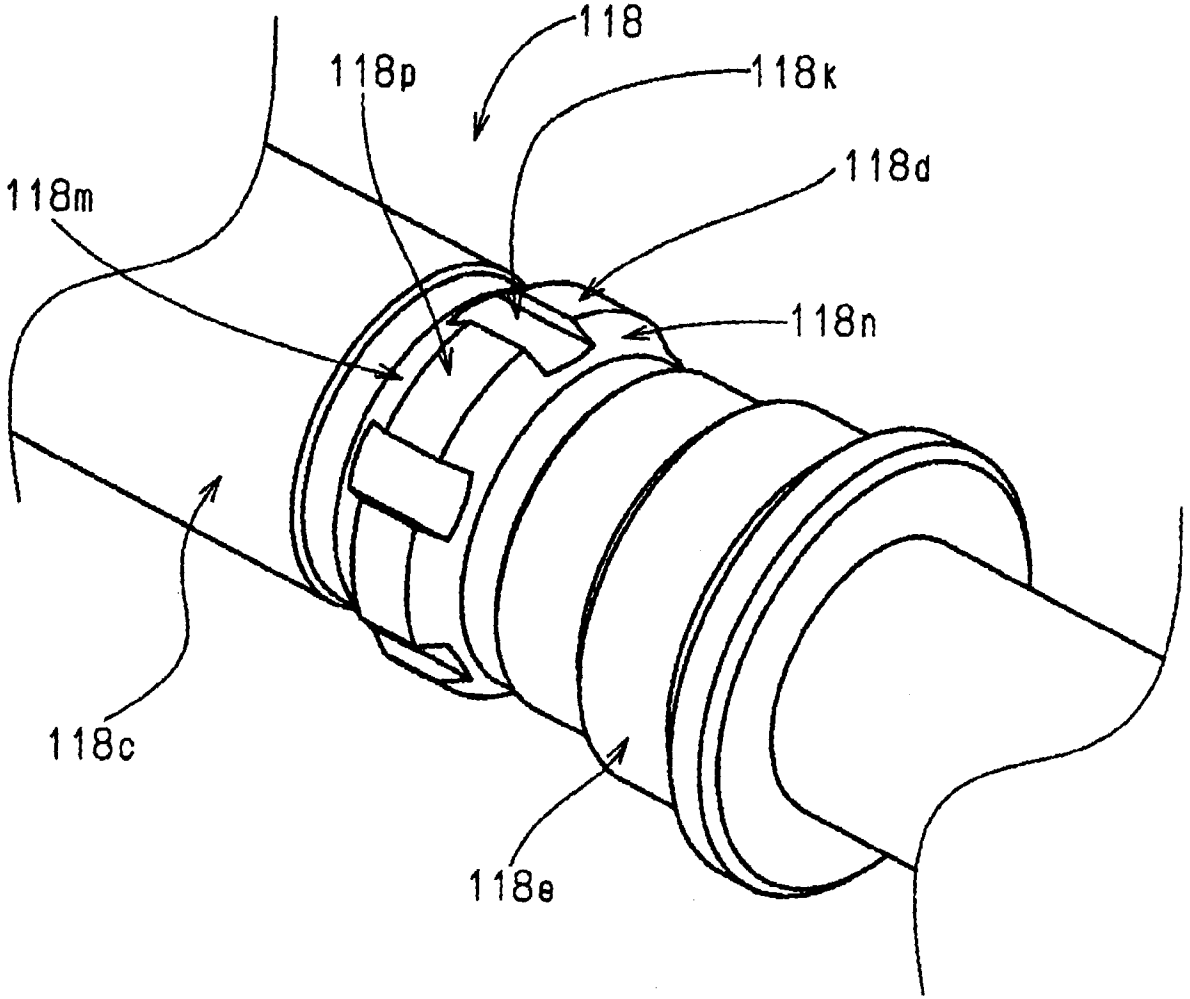
FIG. 7 is a partial perspective view showing a portion of a key groove of the hand setting stem according to the first embodiment of the timepiece having the display correcting mechanism of the invention.

In reference to FIG. 7, the hand setting stern 118 is provided with the winding pinion guide portion 118*c*, the correction transmitting portion 118*d*, and the first corrector setting transmission wheel guide portion 118*e*. One or more of key grooves 118*k* are provided at the correction transmitting portion 118*d*. Although FIG. 7 shows a structure including six of the key grooves 118*k* (however, FIG. 7 illustrates only the three key grooves 118*k* in the six key grooves 118*k*) as an example, a number of the key grooves may be one or may be two or more. It is preferable that a number of the key grooves 118*k* is four through six pieces. It is particularly preferable that a number of the key grooves 118*k* is an even number. When the plurality of key grooves 118*k* are provided, it is preferable to arrange the plurality of key grooves 118*k* at equal intervals (at angular intervals constituting an equal angle) at an outer peripheral portion of the correction transmitting portion 118*d*. A dimension and a shape of the key groove 118*k* of the hand setting stem 118 are set to be able to receive the key portion 280 of the correction transmitting spring 280. By providing the plurality of pieces of key grooves 118*k* at the hand setting stem 118, the correction transmitting spring 280 and the hand setting stem 118 can be cooperatively moved firmly and swiftly.

In reference to FIG. 1, the first corrector setting wheel 281 integrated with the correction transmitting spring 280 is arranged between two guide wall portions provided at the main plate 102. In this case, the correction transmitting spring 280 is arranged on a side of the first corrector setting transmission wheel 281 proximate to the center of the movement 100. However, the correction transmitting spring 280 can also be arranged to a side of the first corrector setting transmission wheel 281 proximate to an outer peripheral portion of the movement 100. By providing the two guide wall portions at the main plate 102, the first corrector setting transmission wheel 281 integrated with the correction transmitting spring 280 can effectively be restricted from being moved in the center axis line direction of the hand setting stem 118.

(1-8) Operation of the Date Correcting Mechanism

Operation of the date correcting mechanism will be explained as follows. In reference to FIG. 1 and FIG. 4, in the state of setting the hand setting stem 118 to 0 stage, as described above, the first corrector setting transmission wheel 281 is rotatably supported by the first corrector setting transmission wheel guide portion 118*e* of the hand setting stem 118. Even when the hand setting stem 118 is rotated under the state, the first corrector setting transmission wheel 281 is not rotated and date correction cannot be carried out. Next, in reference to FIG. 1, FIG. 7 and FIG. 8, when the hand setting stem 118 is drawn out from 0 stage to 1 stage, an outer side inclined face 118*n* of the hand setting stem 118 impinges on the front end of the key portion 280 of the correction transmitting spring 280, and the key portion 280 of the correction transmitting spring 280 is widened to the outer side in the radius direction. Next, via a state of sliding the key portion 280 of the correction transmitting spring 280 above the outer side inclined face 118*n*, the key portion 280*d* of the correction transmitting spring 280 can be brought into the key groove 118*k* of the hand setting stem 118 or mounted on an outer peripheral face 118*p* of the correction transmitting portion 118*d* of the hand setting stem 118 (on an outer peripheral face thereof where the key groove 118*k* is not present). By providing the outer side inclined face 118*n* at the hand setting stem 118, the correction transmitting spring 280 can easily be slid above the correction transmitting portion 118*d* of the hand setting stem 118 and wear of the hand setting stem 118 and the correction transmitting spring 280 can effectively be hampered.

Figure 8:
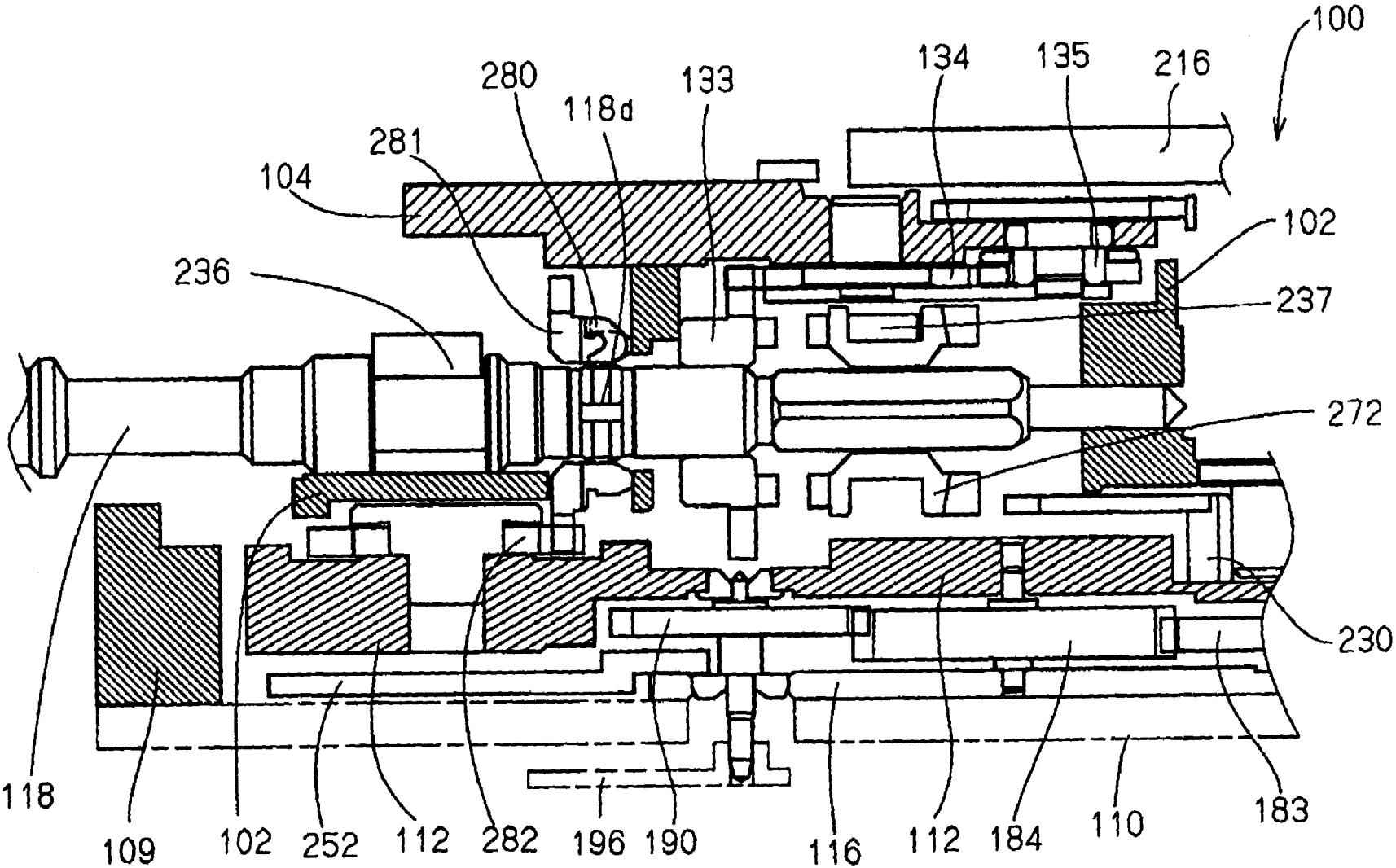
FIG. 8 is a partial sectional view showing a portion of the hand setting stem in a state of setting the hand setting stem to 1 stage according to the first embodiment of the timepiece having the display correcting mechanism of the invention.

Next, in reference to FIG. 8, in a state of drawing out the hand setting stem 118 from 0 stage to 1 stage, the key groove 118*k* of the hand setting stem 118 can receive the key portion 280*d* of the correction transmitting spring 280. When in a state of drawing out the hand setting stem 118 to 1 stage, the key groove 118*k* of the hand setting stem 118 matches with the key portion 280*d* of the correction transmitting spring 280, the key portion 280*d* of the correction transmitting spring 280 can be brought into the key groove 118*k* of the hand setting stem 118. When the hand setting stem 118 is rotated in one direction under the state, the first corrector setting transmission wheel 281 is rotated, further, the date corrector setting wheel 259 is pivoted in one direction via rotation of the second corrector setting transmission wheel 282, the third corrector setting transmission wheel 283, the fourth corrector setting transmission wheel 284 and the fifth corrector setting transmission wheel 258 to stop at a first position, and at the first position, the date indicator 252 is constituted to be able to be rotated by rotating the corrector setting wheel 259. Even when the hand setting stem 118 is rotated in other direction in the state of setting the hand setting stem 118 to 1 stage, the date indicator 252 cannot be rotated.

As a modified example, in a state of providing a 24 hour display wheel, a month display wheel, a lunar age display wheel or the like, by rotating the hand setting stem 118 in the state of drawing out the hand setting stem 118 from 0 stage to 1 stage, the display wheel can be constituted to correct. Or, according to a constitution having an hour correcting mechanism or the like, in a state of drawing out the hand setting stem 118 to 1 stage or 2 stage or 3 stage, or in the state of setting the hand setting stem 118 at 0 stage, hour correction can be constituted to be able to carry out by rotating the hand setting stem 118. With regard to an hour correcting mechanism (time difference correcting mechanism), the mechanism is disclosed in JP-A-2000-147145 or the like and therefore, a detailed explanation thereof will be omitted.

In the state of drawing out the hand setting stem 118 to 1 stage, when the key groove 118*k* of the hand setting stem 118 does not match the key portion 280*d* of the correction transmitting spring 280, the outer side inclined face 118*n* of the hand setting stem 118 impinges on the front end of the key portion 280*d* of the correction transmitting spring 280 and the key portion 280 of the correction transmitting spring 280 is widened to the outer side in the radius direction. Successively, the front end of the key portion 280*d* is mounted on the correction transmitting portion 118*d* of the hand setting stem 118 (on an outer peripheral face thereof where the key groove 118*k* is not present). When the hand setting stem 118 is rotated under the state, the hand setting stem 118 is rotated relative to the first corrector setting transmission wheel 281, and when the key groove 118*k* of the hand setting stem 118 matches with the key portion 280*d* of the correction transmitting spring 280, the key portion 280*d* of the correction transmitting spring 280 can be brought into the key groove 118*k* of the hand setting stem 118. When the hand setting stem 118 is rotated in one direction under the state, the first corrector setting transmission wheel 281 is rotated, the corrector setting wheel 259 is pivoted in one direction via rotation of the second corrector setting transmission wheel 282, the third corrector setting transmission wheel 283, the fourth corrector setting transmission wheel 284 and the fifth corrector setting transmission wheel 258 to stop at the first position and the corrector setting wheel 259 is constituted to be able to rotate the date indicator 252 at the first position. Even when the hand setting stem 118 is rotated in other direction under the state of setting the hand setting stem 118 to 1 stage, the date indicator 252 is constituted not to be able to rotate. In the state of setting the hand setting stem 118 to 1 stage, when the hand setting stem 118 is pressed to 0 stage, the key groove 118*k* of the hand setting stem 118 is separated from the key portion 280*d* of the correction transmitting spring 280. Even when the hand setting stem 118 is rotated under the state, the first corrector setting transmission wheel 281 is not rotated and the date correction cannot be carried out.

Figure 9:
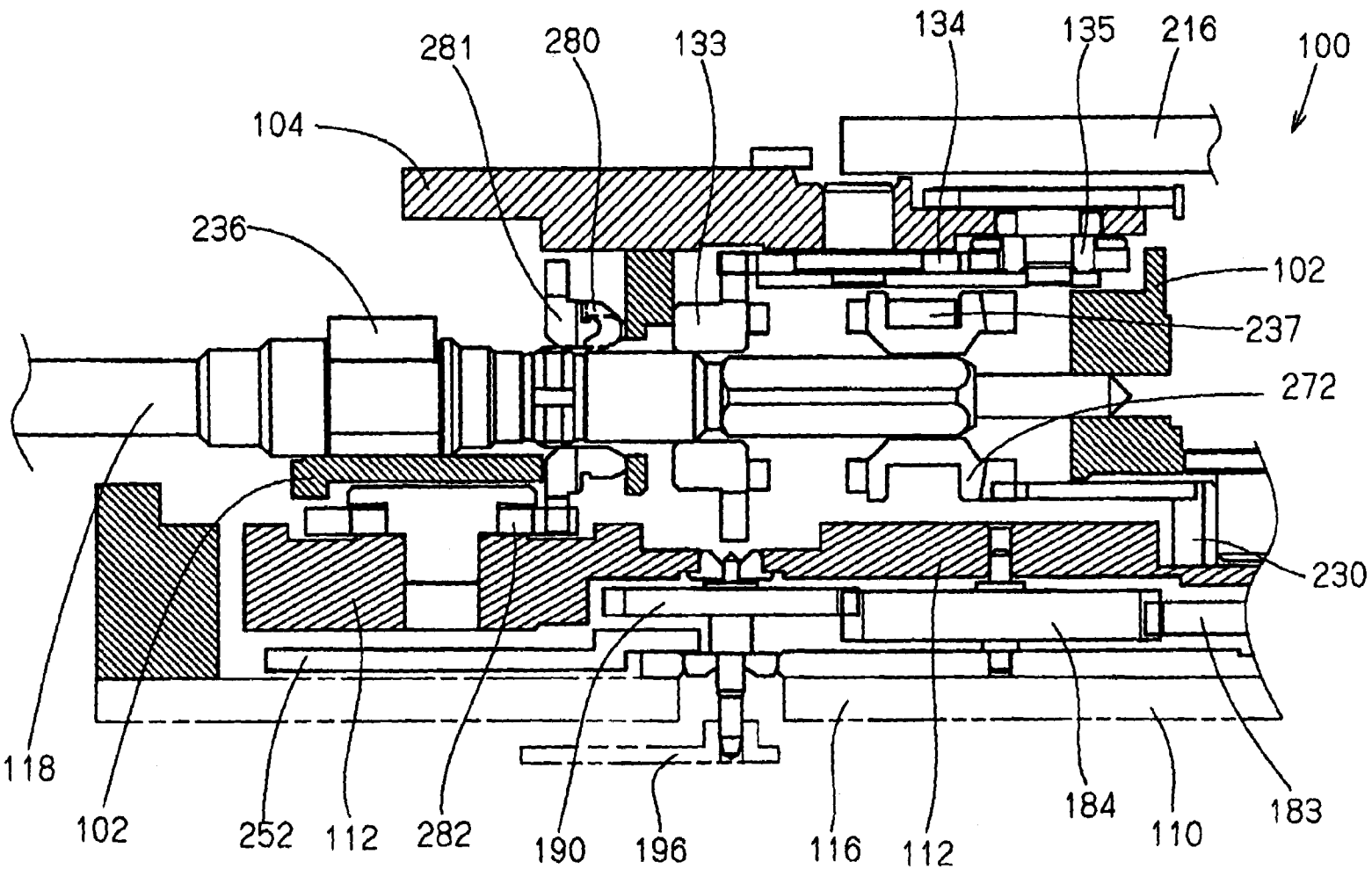
FIG. 9 is a partial sectional view showing the portion of the hand setting stem in a state of setting the hand setting stem to 2 stage according to the first embodiment of the timepiece having the display correcting mechanism of the invention.

Next, in reference to FIG. 9, in a state of drawing out the hand setting stem 118 from 1 stage to 2 stage, the key groove 118*k* of the hand setting stem 118 is separated from the key portion 280*d* of the correction transmitting spring 280. Therefore, in the state of setting the hand setting stem 118 to 2 stage, even when the hand setting stem 118 is rotated, the date indicator 252 cannot be rotated. Further, in reference to FIG. 1, FIG. 7 and FIG. 8, when the hand setting stem 118 is pressed from 2 stage to 0 stage, an inner side inclined face 118*m* of the hand setting stem 118 impinges on the front end of the key portion 280*d* of the correction transmitting spring 280 to widen the key portion 280*d* of the correction transmitting spring 280 to the outer side in the radius direction. Successively, the key portion 280*d* of the correction transmitting spring 280 is brought into the key groove 118*k* of the hand setting stem 118 or mounted on the outer peripheral face 118*p* of the correction transmitting portion 118*d* of the hand setting stem 118 (on the outer peripheral face where the key groove 118*k* is not present). By providing the inner side inclined face 118*m* at the hand setting stem 118, the correction transmitting spring 280 can easily slid on the correction transmitting portion 118*d* of the hand setting stem 118, and wear of the hand setting stem 118 and the correction transmitting spring 280 can effectively be hampered. Further, there is brought about the state in which the hand setting stem 118 is present at 0 stage shown in FIG. 1 via a state in which the front end of the key portion 280*d* of the correction transmitting spring 280 is slid on the inner side inclined face 118*m* of the hand setting stem 118. By providing the inner side inclined face 118*m* and the outer side inclined face 118*n* at the hand setting stem 118, the correction transmitting spring 280 can easily be slid on the correction transmitting portion 118*d* of the hand setting stem 118 and wear of the hand setting stem 118 and the correction transmitting spring 280 can effectively be hampered.

(1-9) Operation of Hand Setting

In reference to FIG. 9, in the state of setting the hand setting stem 118 to 2 stage, the A tooth 272*a* of the clutch wheel 272 is constituted to be brought in mesh with the gear portion of the minute wheel 230. When the hand setting stem 118 is rotated in the state of setting the hand setting stem 118 to 2 stage, the clutch wheel 272 is rotated, and the minute wheel 230 is rotated. When the minute wheel 230 is rotated, the hour pinion of the center wheel & pinion 122 and the hour wheel 232 are rotated, and hand setting (that is, correction of time) can be carried out by rotating the hour hand (not illustrated) and the minute hand (not illustrated). Further, in reference to FIG. 1, FIG. 3, FIG. 7 and FIG. 8, in the state of setting the hand setting stem 118 to 2 stage, the balance rectifying lever 140 is brought into contact with the balance ring 142*c* of the balance with hairspring 142 to rectify rotation of the balance with hairspring 142. When the hand setting stem 118 is pressed from 2 stage to 0 stage, the balance rectifying lever 140 is separated from the balance wheel 142*c* of the balance with hairspring 142. Therefore, in the state of setting the hand setting stem 118 to 1 stage and the state of setting the hand setting stem 118 to 0 stage, the balance ring 142*c* can freely be rotated.

(1-10) Constitution of Indicator Feeding Mechanism

Next, a constitution of an indicator feeding mechanism will be explained. In reference to FIG. 1 and FIG. 4, when needed, in the timepiece having the calendar correcting mechanism of the invention, the back side of the movement 100 can be arranged with a single mechanism or a plurality of mechanisms of a day display mechanism, a day correcting mechanism, a 24 hour display mechanism, a month display mechanism, a lunar age display mechanism, a chronograph display mechanism, and a mainspring winding state display mechanism. The indicator 190 is rotatably supported by the second main plate 112 and the date indicator maintaining plate 116. A rotational center of the indicator 190 is arranged on an inner side of a tooth tip circle of the date indicator 252. According to the embodiment of the invention, it is preferable to arrange the indicator 190 to overlap the center axis line of the hand setting stem 118. It is further preferable to arrange the rotational center of the indicator 190 on the center axis line of the hand setting stem 118. Time information, calendar information, mainspring winding state or the like can be indicated by a display hand 196 provided at a stem portion of the indicator 190.

For example, when "day" is indicated by the display hand 196, a day display mechanism is constituted to operate based on rotation of the back train wheel. The day display mechanism can be constituted to include a transmitting train wheel 192 rotated by rotation of the hour wheel 232 and the indicator 190 rotated by rotation of the transmitting train wheel 192. According to the constitution, the indicator 190 is constituted to rotate by (1/7) once per day. It is preferable to provide an indicator jumper to rectify a position of the indicator 190. Or, when "hour" is indicated per 24 hours (time display by a 24 hour hand rotated by one rotation in 24 hours) by the display hand 196, a 24 hour display mechanism is constituted to operate based on rotation of the back train wheel. The 24 hour display mechanism can be constituted to include the transmitting train wheel 192 rotated by rotation of the hour wheel 232 and the indicator 190 rotated by rotation of the transmitting train wheel 192. According to the constitution, the indicator 190 is constituted to rotate by one rotation per 24 hours.

Figure 4:
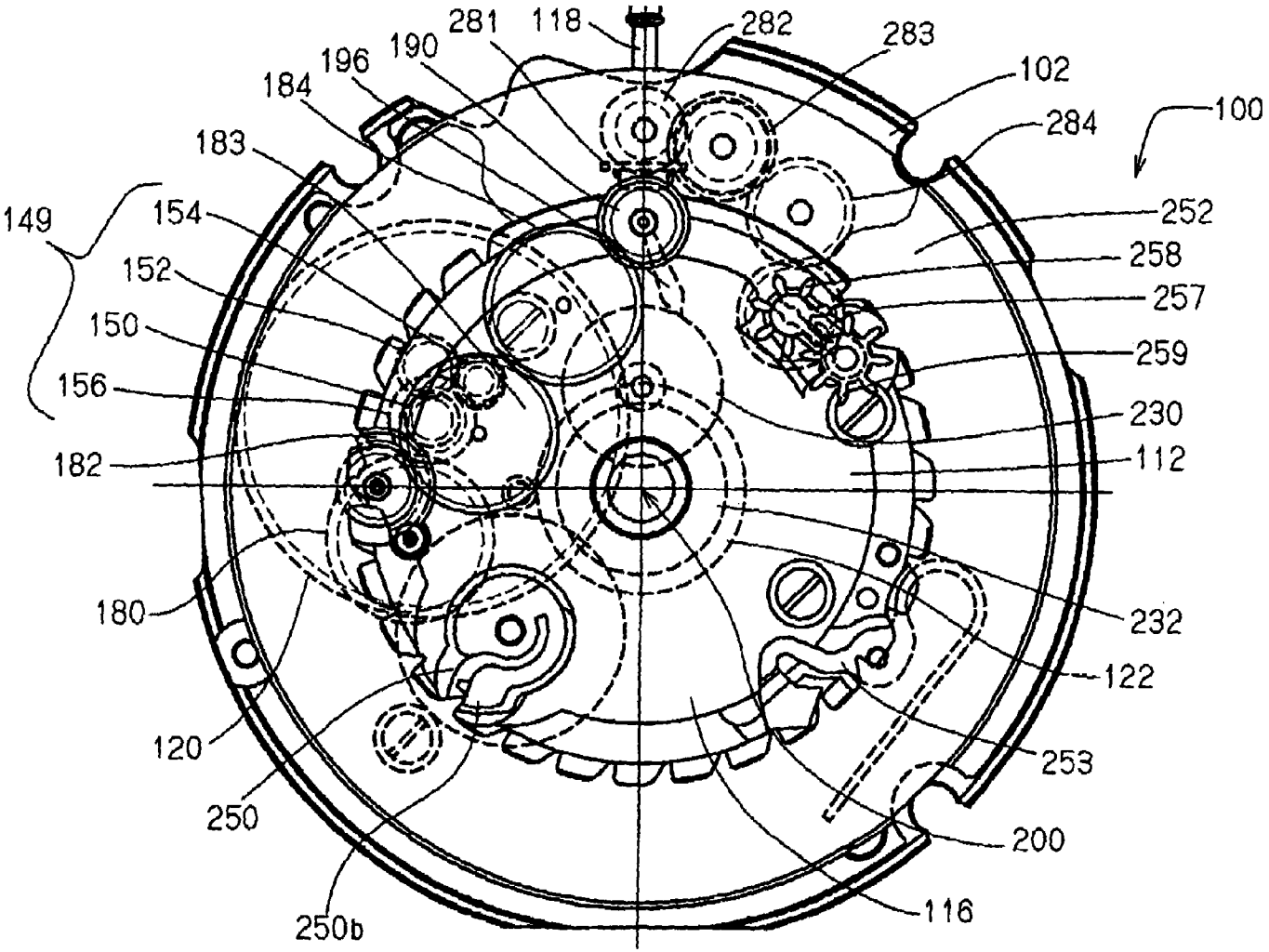
FIG. 4 is a plane view (back plane view) showing a state of viewing the movement from a dial side according to the first embodiment of the timepiece having the display correcting mechanism of the invention.

In reference to FIG. 4, for example, when the mainspring winding state is indicated by the indicator 196, the mainspring winding state display mechanism is constituted to operate based on rotation of the barrel stem. The mainspring winding state display mechanism can be constituted to include a planetary mechanism 149, the transmitting train wheel and the indicator 190. The planetary mechanism 149 constitutes a speed reducing mechanism cooperatively moved with the barrel gear for reducing a speed of rotation of the barrel gear. The planetary mechanism includes a first sun wheel 150, a first planetary wheel 152, a second planetary wheel 154, and a second sun wheel 156. The first sun wheel 150, is fixed to a lower shaft portion of the barrel stem of the barrel complete 120. The first planetary wheel 152 is rotatably attached to a bottom face of the barrel gear. The second planetary wheel 154 is rotatably attached to the bottom face of the barrel gear. The second sun wheel 156 is rotatably attached to a lower tip end of the shaft portion of the barrel stem of the barrel complete 120. The first sun wheel 150 is constituted to be brought in mesh with the first planetary wheel 152. The first planetary wheel 152 is constituted to be brought in mesh with the second planetary wheel 154. The second planetary wheel 154 is constituted to be brought in mesh with the second sun wheel 156. The first planetary wheel 152 is constituted to be able to be rotated while revolving around the first sun wheel 150 when the barrel gear is rotated. When the barrel gear is rotated, the second planetary wheel 154 is constituted to be able to rotate while revolving around the first sun wheel 150.

The intermediate first indicator 180 is rotatably supported by the main plate 102 and the date indicator maintaining plate 116. The intermediate first indicator 180 includes an intermediate first indicator gear and an intermediate first indicator pinion. An intermediate second indicator 182 is rotatably supported by the second main plate 112 and the date indicator maintaining plate 116. The intermediate second indicator 182 includes an intermediate second indicator gear and an intermediate second indicator pinion. An intermediate third indicator 183 is rotatably supported by the main plate 102 and the date indicator maintaining plate 116. An intermediate fourth indicator 184 is rotatably supported by the second main plate 112 and the date indicator maintaining plate 116. The intermediate first indicator gear is constituted to be brought in mesh with the second sun wheel 156. The intermediate second indicator gear is constituted to be brought in mesh with the intermediate first indicator pinion. The intermediate third indicator 183 is constituted to be brought in mesh with the intermediate second indicator pinion. The intermediate fourth indicator 184 is constituted to be brought in mesh with the intermediate third indicator 183. The indicator 190 is constituted to be brought in mesh with the intermediate fourth indicator 184. By operating the planetary mechanism 149, the indicator 190 is constituted to rotate via rotation of the intermediate first indicator 180, the intermediate second indicator 182, the intermediate third indicator 183 and the intermediate fourth indicator 184. In addition thereto, other indicator (for example, day indicator, 24 hour indicator or the like) having other function can also be provided at other position.

(2) Second Embodiment

Next, a second embodiment of a timepiece having a display correcting mechanism of the invention will be explained. In the following explanation, a description will mainly be given of a point of differing the second embodiment of the timepiece having a display correcting mechanism of the invention from the first embodiment of the timepiece having the display correcting mechanism of the invention. Therefore, the above-described explanation of the first embodiment of the timepiece having the display correcting mechanism of the invention will be applied to a portion which is not described in the following. A characteristic of the second embodiment of the timepiece having the display correcting mechanism of the invention resides in that a hand setting mechanism is not provided and an indicator arranged on a center axis line of a hand setting stem is not provided. According to the second embodiment of the timepiece having a display correcting mechanism of the invention, a second main plate is not provided. However, the second main plate may be provided in the second embodiment of the timepiece having a display correcting mechanism of the invention.

(2-1) Constitution of a Switching Mechanism

Figure 10:
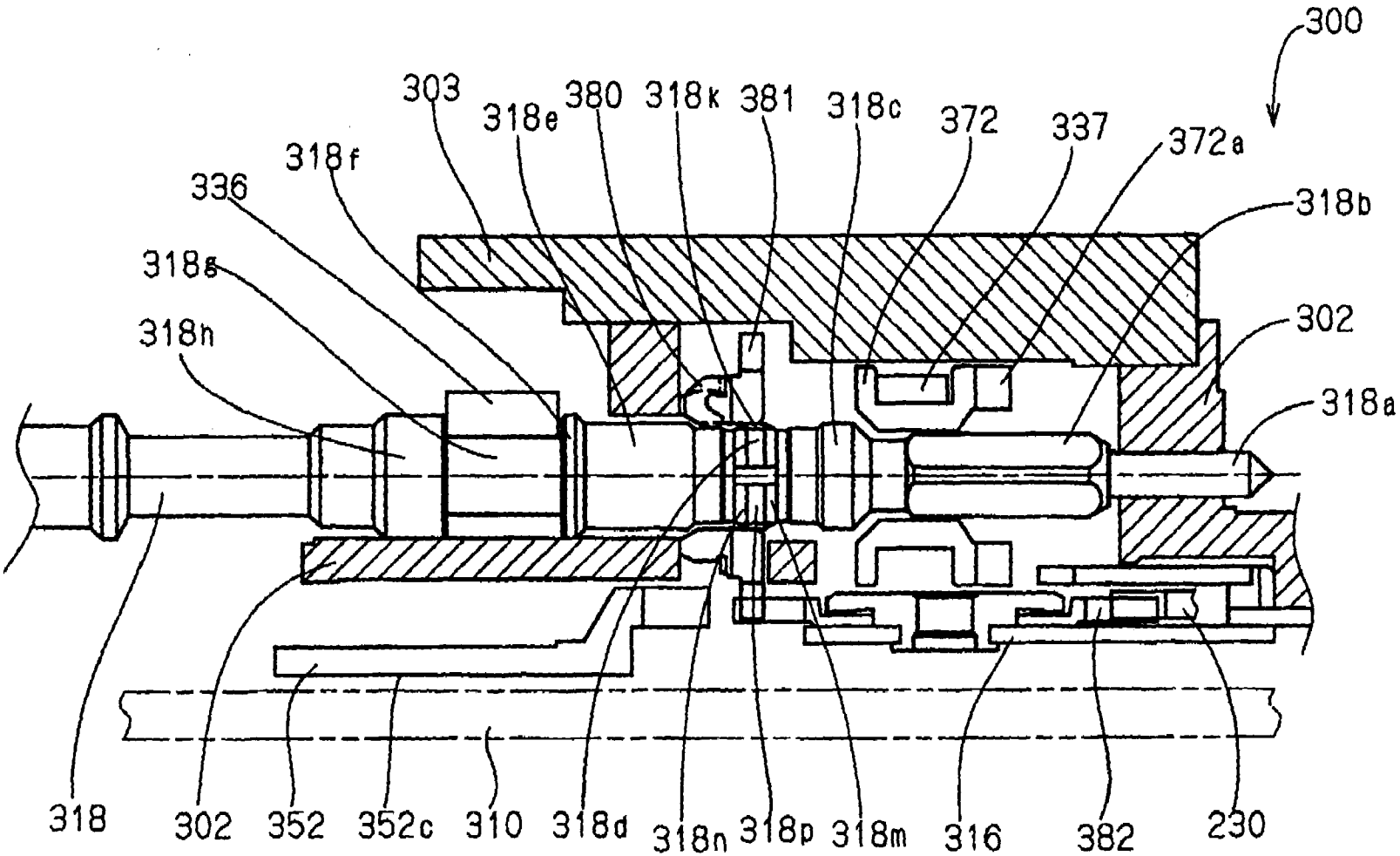
FIG. 10 is a partial sectional view showing the portion of the hand setting stem in a state of setting the hand setting stem to 0 stage according to a second embodiment of the timepiece having the display correcting mechanism of the invention.

First, a constitution of a switching mechanism will be explained. According to the second embodiment of the timepiece having a display correcting mechanism of the invention, a movement 300 is provided with the switching mechanism and a time setting mechanism for setting time of the timepiece. In reference to FIG. 10, the switching mechanism includes a setting lever 336, a yoke 337, and a yoke holder (not illustrated). The setting lever 336, the yoke 337 and the yoke holder are operably supported by a main plate 302. The time setting mechanism includes a hand setting stem 318 and a clutch wheel 372. The hand setting stem 318 includes a front end shaft portion 318*a*, a square shaft portion 318*b*, a first correction transmitting wheel guide portion 318*c*, a correction transmitting portion 318*d*, an intermediate shaft portion 318*e*, a clutch wheel inner wall portion 318*f*, a clutch wheel receiving portion 318*g*, a clutch wheel outer wall portion 318*h* and the like formed in this order from a front end portion to an outer portion. It is preferable to provide an inner side inclined face 318*m* at a portion of the correction transmitting portion 318*d* of the hand setting stem 318 in an inner side direction of a movement 300. It is preferable to provide an outer side inclined face 318*n* at a portion of the correction transmitting portion 318*d* of the hand setting stem 318 in an outer side direction of the movement 300. The front end shaft portion 318*a* of the hand setting stem 318 is rotatably supported by a front end hole of the hand setting stem of the main plate 302. A square hole portion of the clutch wheel 372 is integrated to the square shaft portion 318*b* of the hand setting stem 318. A portion of the clutch wheel 336 brought into contact with the hand setting stem is disposed between the clutch wheel inner wall portion 318*e* and the clutch wheel outer portion 318*g* of the hand setting stem 318. The clutch wheel 372 is provided with A tooth 372*a* disposed on a side proximate to a center portion of the movement 100.

The clutch wheel 372 is not provided with B tooth. The movement 300 is not provided with a hand setting mechanism. That is, the movement 300 is not provided with a winding pinion, a crown wheel, and a crown transmission wheel. In a state of setting the hand setting stem 318 to 0 stage and a state of setting the hand setting stem 318 to 1 stage, the A tooth 372*a* of the clutch wheel 372 is constituted not to be brought in mesh with a gear portion of the minute wheel 230. In a state of setting the hand setting stem 318 to 2 stage, the A tooth 372*a* of the clutch wheel 372 is constituted to be brought in mesh with the gear portion of the minute wheel 230. When the hand setting stem 318 is rotated in the state of setting the hand setting stem 118 to 2 stage, the clutch wheel 372 is rotated and the minute wheel 230 is rotated. When the minute wheel 230 is rotated, the hour pinion of the center wheel & pinion 122 and the hour wheel 232 are rotated, and the hand setting (that is, correction of time) can be carried out by rotating the hour hand (not illustrated) and the minute hand (not illustrated).

(2-2) Constitution of a Date Correcting Mechanism

Next, a constitution of a date correcting mechanism will be explained. In reference to FIG. 10, in the timepiece having a calendar correcting mechanism of the invention, a back side of the movement 300 is provided with a date correcting mechanism for correcting display of date by a date indicator 352 from a window of a dial 310. The date correcting mechanism is constituted by a first corrector setting transmission wheel 381, a second corrector setting transmission wheel 382, a third corrector setting transmission wheel 383, a fourth corrector setting transmission wheel (not illustrated) and a corrector setting wheel (not illustrated). A structure of the first corrector setting transmission wheel 381 is similar to the structure of the first corrector setting transmission wheel 281 according to the first embodiment of the timepiece of the invention. A structure of a correction transmitting spring 380 is similar to a structure of the correction transmitting spring 280 according to the first embodiment of the timepiece of the invention. A base inner diameter portion of the correction transmitting spring 380 is fitted to an outer peripheral portion of a ring-like band portion of the first corrector setting transmission wheel 381. Therefore, the structure of the first corrector setting transmission wheel 381 attached with the correction transmitting spring 380 is similar to a structure of the first corrector setting transmission wheel 281 attached with the correction transmitting spring 280 according to the first embodiment of the timepiece of the invention (refer to FIG. 5).

In a state of setting the hand setting stem 318 to 0 stage, the first corrector setting transmission wheel 381 is rotatably supported by an outer peripheral portion 318*p* of the correction transmitting portion 318*d* of the hand setting stem 318. The first corrector setting transmission wheel 381 integrated with the correction transmitting spring 380 is arranged operably between two guide wall portions provided at the main plate 302. In this case, different from arrangement of the first embodiment of the timepiece of the invention, the correction transmitting spring 380 is arranged on a side of the first corrector setting transmission wheel 381 proximate to an outer peripheral portion of the movement 300. However, the correction transmitting spring 380 can be arranged at a side of the first corrector setting transmission wheel 381 proximate to a center of the movement 300 as similar to the position of the first embodiment of the timepiece of the invention. A structure of the fourth corrector setting transmission wheel is similar to the structure of the fifth corrector setting transmission wheel 258 according to the first embodiment of the timepiece of the invention. The structure of the corrector setting wheel is similar to a structure of the corrector setting wheel 259 according to the first embodiment of the timepiece of the invention.

The second corrector setting transmission wheel 382 is rotatably supported by the date indicator maintaining plate 316. A rotational center of the second corrector setting transmission wheel 382 is arranged on an inner side of a tooth tip circle of the date indicator 352. According to the embodiment of the invention, it is preferable to arrange the second corrector setting transmission wheel 382 to overlap a center axis line of the hand setting stem 318. It is further preferable to arrange a rotational center of the second corrector setting transmission wheel 282 on the center axis line of the hand setting stem 318 at a position which does not overlap the date display face 252*c* of the date indicator 252. A rotational center of the second corrector setting transmission wheel 382 is disposed on an inner side of a position of arranging the first corrector setting transmission wheel 381. The third corrector setting transmission wheel 283 is rotatably supported by the date indicator maintaining plate 316. A rotational center of the third corrector setting transmission wheel 383 is arranged on an inner side of the tooth tip circle of the date indicator 352. The rotational center of the third corrector setting transmission wheel 383 can also be arranged on an outer side of the tooth tip circle of the date indicator 352. The fourth corrector setting transmission wheel is rotatably supported by the main plate 302. A rotational center of the fourth corrector setting transmission wheel is arranged on the inner side of tooth tip circle of the date indicator 352. The corrector setting wheel is pivoted relative to the main plate 302 by a constant angle and is supported thereby to be able to rotate at the pivoted position. A rotational center of the corrector setting wheel is arranged on the inner side of the tooth tip circle of the date indicator 352.

(2-3) Operation of Date Correcting Mechanism

Figure 11:
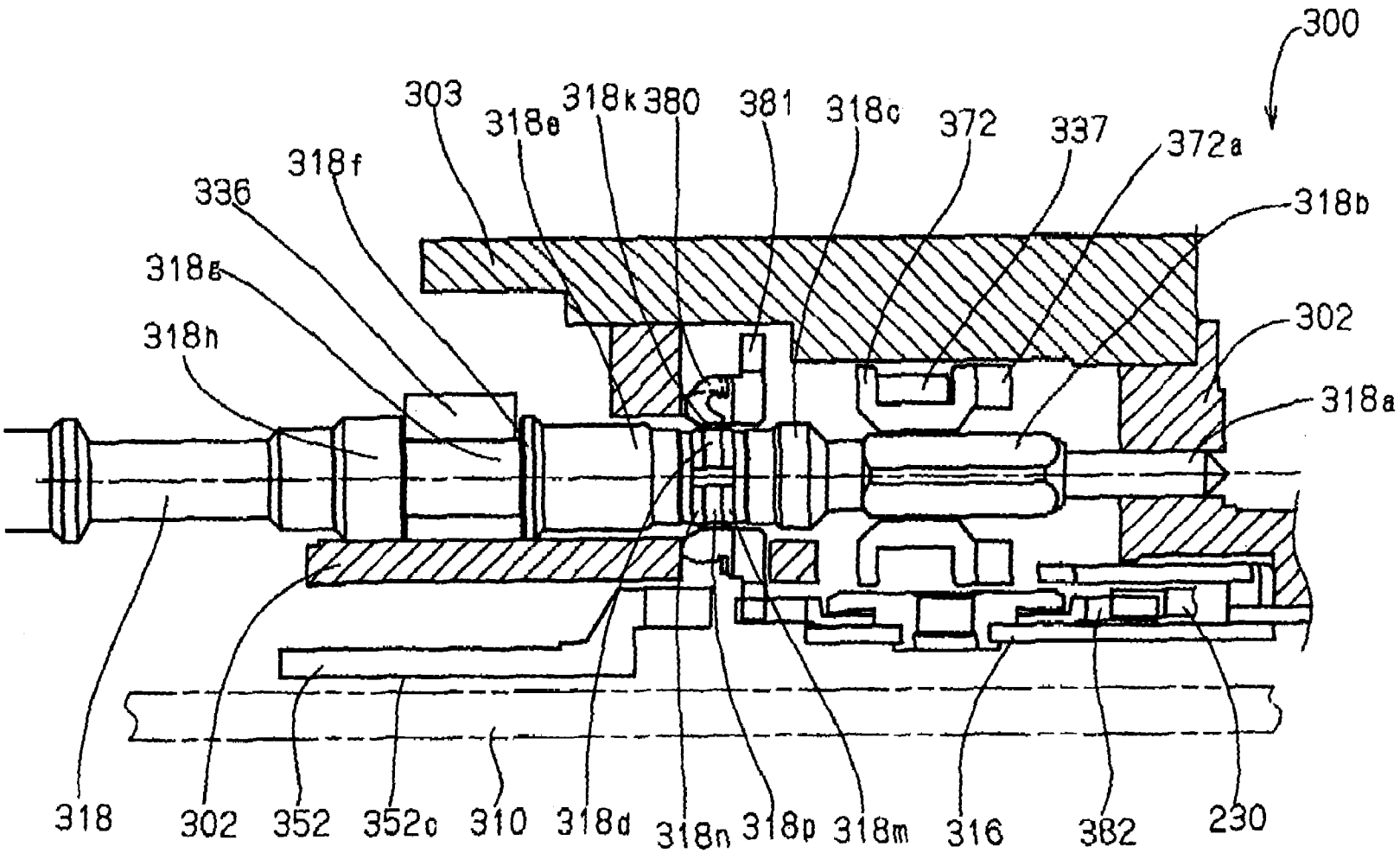
FIG. 11 is a partial sectional view showing the portion of the hand setting stem in the state of setting the hand setting stem to 1 stage according to the first embodiment of the timepiece having the display correcting mechanism of the invention.

Operation of the date correcting mechanism will be explained as follows. In reference to FIG. 10, in the state of setting the hand setting stem 318 to 0 stage, as described above, the first corrector setting transmission wheel 381 is rotatably supported by the outer peripheral portion 318*p* of the correction transmitting portion 318*d* of the hand setting stem 318. Even when the hand setting stem 318 is rotated under the state, the first corrector setting transmission wheel 381 is not rotated and date correction cannot be carried out. Next, in reference to FIG. 11, when the hand setting stem 318 is drawn out from 0 stage to 1 stage, the outer side inclined face 318*n* of the hand setting stem 318 impinges on the front end of the key portion 380 of the correction transmitting spring 380 to widen the key portion 380*d* of the correction transmitting spring 380 to the outer side in the radius direction. Successively, via a state in which the key portion 380*d* of the correction transmitting spring 380 is slid on the outer side inclined face 318*n*, the key portion 380*d* of the correction transmitting spring 380 can be brought into a key groove 318*k* or mounted on the outer peripheral face 318*p* of the correction transmitting portion 318*d* of the hand setting stem 318 (on an outer peripheral face where the key groove 318*k* is not present). In a state of drawing out the hand setting stem 318 from 0 stage to 1 stage, the key groove 318*k* of the hand setting stem 318 can receive the key portion 380*d* of the correction transmitting spring 380.

When in the state of drawing out the hand setting stem 318 to 1 stage, the key groove 318*k* of the hand setting stem 318 matches with the key portion 380*d* of the correction transmitting spring 380, the key portion 380*d* of the correction transmitting spring 380 can be brought into the key groove 318*k* of the hand setting stem 318. When then hand setting stem 318 is rotated in one direction under the state, the first corrector setting transmission wheel 381 is rotated, further the corrector setting wheel is pivoted in one direction via rotation of the second corrector setting transmission wheel 382, the third corrector setting transmission wheel 383 and the fourth corrector setting transmission wheel to stop at the first position, and the date indicator 352 is constituted to be able to be rotated by rotating the corrector setting wheel at the first position (refer to FIG. 4). When the hand setting stem 318 is rotated in other direction in the state of setting the hand setting stem 318 to 1 stage, the date indicator 352 cannot be rotated.

In contrast thereto, in the state of drawing out the hand setting stem 318 to 1 stage, when the key groove 318*k* of the hand setting stem 318 does not match the key portion 380*d* of the correction transmitting spring 380, the key portion 380*d* of the correction transmitting spring 380 is widened to the outer side in the radius direction, and the front end of the key portion 380*d* can be mounted on the correction transmitting portion 318*d* of the hand setting stem 318 (on an outer peripheral face thereof where the key groove 318*k* is not present). When the hand setting stem 318 is rotated under the state, the hand setting stem 318 is rotated relative to the first corrector setting transmission wheel 381, and when the key groove 318*k* of the hand setting stem 318 matches the key portion 380*d* of the correction transmitting spring 380, the key portion 380*d* of the correction transmitting spring 380 can be brought into the key groove 318*k* of the hand setting stem 318. When the hand setting stem 318 is rotated in one direction under the state, the first corrector setting transmission wheel 381 is rotated, further, the corrector setting wheel is pivoted in one direction via rotation of the second corrector setting transmission wheel 382, the third corrector setting transmission wheel 383 and the fourth corrector setting transmission wheel to stop at the first position and the date indicator 352 is constituted to be able to be rotated by rotating the corrector setting wheel at the first position (refer to FIG. 4). Even when the hand setting stem 318 is rotated to other direction under the state of setting the hand setting stem 318 to 1 stage, the date indicator 352 is constituted not to be able to be rotated. In the state of setting the hand setting stem 318 to 1 stage, when the hand setting stem 318 is pressed to 0 stage, the key groove 318*k* of the hand setting stem 318 is separated from the key portion 380*d* of the correction transmitting spring 380. Even when the hand setting stem 318 is rotated under the state, the first corrector setting transmission wheel 381 is not rotated and date correction cannot be carried out.

Figure 12:
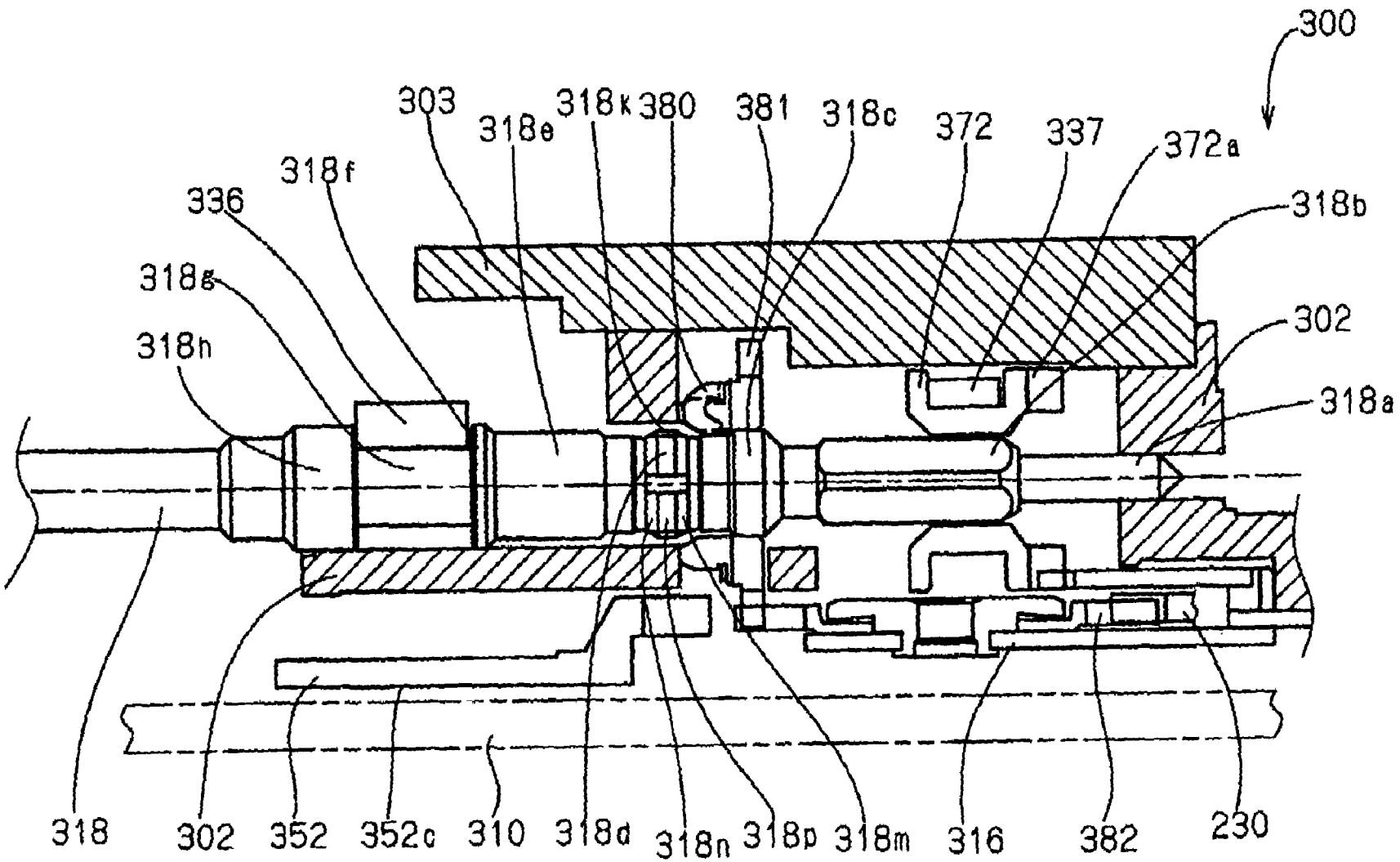
FIG. 12 is a partial sectional view showing the portion of the hand setting stem in the state of setting the hand setting stem to 2 stage according to the first embodiment of the timepiece having the display correcting mechanism of the invention.

Next, in reference to FIG. 12, in the state of drawing out the hand setting stem 318 from 1 stage to 2 stage, the key groove 318*k* of the hand setting stem 318 is separated from the key portion 280*d* of the correction transmitting spring 380 and the first corrector setting transmission wheel 381 is mounted on the first corrector setting transmission wheel guide portion 318*c* of the hand setting stem 318. Therefore, even when the hand setting stem 318 is rotated in the state of setting the hand setting stem 318 to 2 stage, the date indicator 352 cannot be rotated.

(2-4) Operation of Hand Setting

In reference to FIG. 12, in the state of setting the hand setting stem 318 to 2 stage, the A tooth 372*a* of the clutch wheel 372 is constituted to be brought in mesh with the gear portion of the minute wheel 230. When the hand setting stem 318 is rotated under the state, the clutch wheel 372 is rotated and the minute wheel 230 is rotated. When the minute wheel 230 is rotated, the hour pinion of the center wheel & pinion (not illustrated) and the hour wheel (not illustrated) are rotated and hand setting can be carried out. According to the second embodiment of the timepiece of the invention, operation of pressing the hand setting stem 318 from 2 stage to 0 stage is similar to the above-described operation according to the first embodiment of the timepiece of the invention.

(2-5) Other Constitution of a Correction Transmitting Spring

Figure 13:
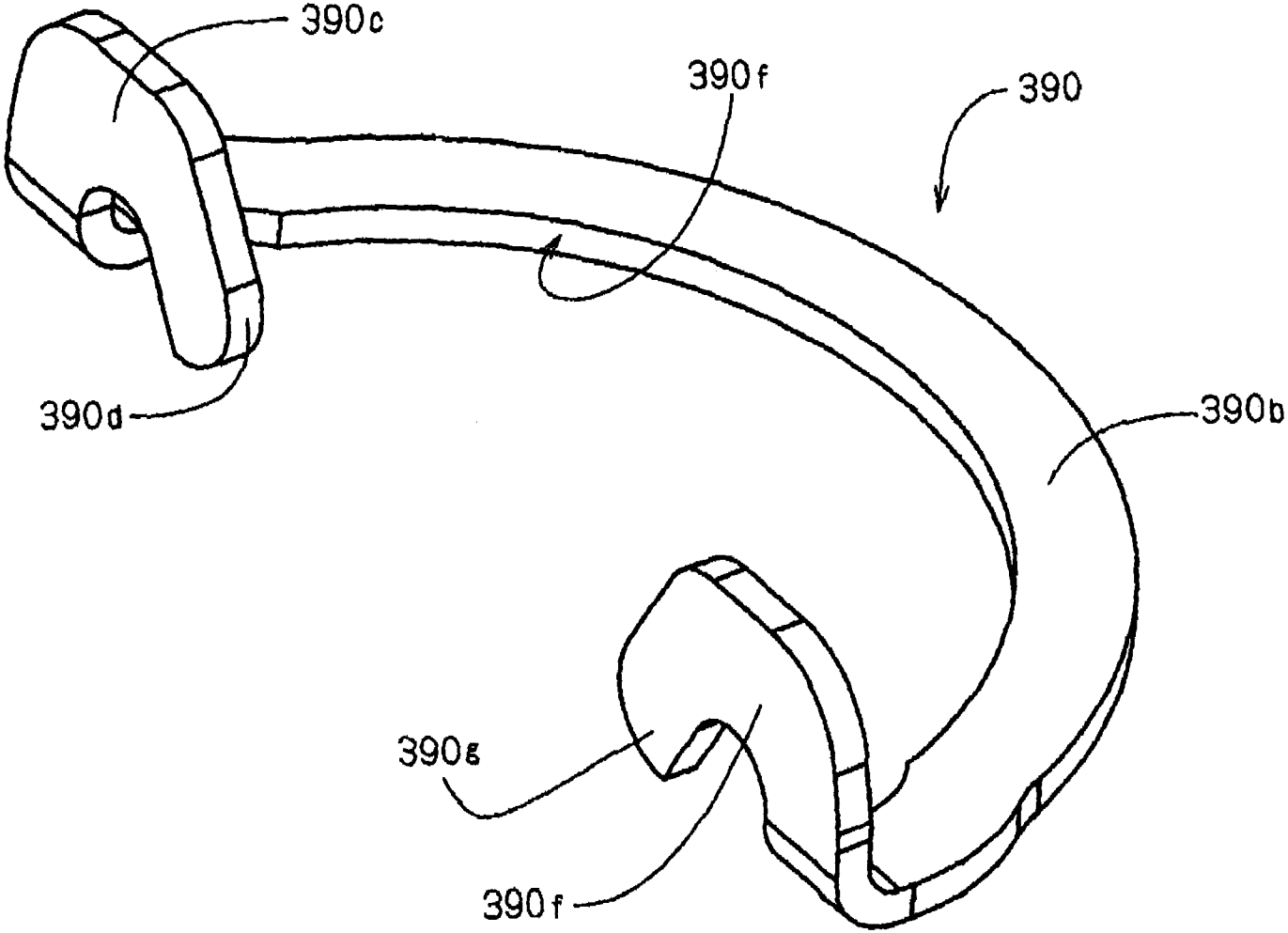
FIG. 13 is a perspective view showing a modified example of a correction transmitting spring according to a second embodiment of a timepiece having a display correcting mechanism of the invention.

Next, other constitution of a correction transmitting spring according to the second embodiment of the timepiece of the invention will be explained. In the following explanation, a description will mainly be given of a point of differing the other constitution of the correction transmitting spring from the correction transmitting spring 280 according to the first embodiment of the timepiece of the invention. Therefore, the above-described explanation of the first embodiment of the timepiece of the invention will be applied to a portion which is not described in the following. In reference to FIG. 13, according to a modified example, a correction transmitting spring 390 includes a base portion 390*b* formed substantially in a C-like shape, a first positioning portion 390*c* formed orthogonally to one end portion of the base portion 390*b* and a second positioning portion 390*f* formed orthogonally to other end portion of the base portion 390*b*. The first key portion 390*d* is provided at a front end of the first positioning portion 390*c*. A second key portion 390*g* is provided at a front end of the second positioning portion 390*f*. It is preferable that an opening angle of the base portion 390*b* is 180 degrees. The correction transmitting spring 280 is formed by an elastic material of stainless steel or the like. The correction transmitting spring 390 according to the second embodiment of the timepiece of the invention can also be applied to the first embodiment of the timepiece having the calendar correcting mechanism of the invention.

The base portion 390*b* includes a base inner diameter portion 390*f* in a semicircular shape. By forming the base portion 390*b* in the semicircular shape, the base portion 380*b* can be widened to an outer side in a radius direction. The base inner diameter portion 390*f* of the correction transmitting spring 390 is fitted to the outer peripheral portion of the ring-like band portion 281*e* of the first corrector setting transmission wheel 281. At this occasion, a first positioning portion 390*c* of the correction transmitting spring 390 is fitted into the one groove portion 281*f* of the first corrector setting transmission wheel 281 and the second positioning portion 390*f* of the correction transmitting spring 390 is fitted into the other groove portion 281*g* of the first corrector setting transmission wheel 281. Under the state, a first key portion 390*d* and a second key portion 390*g* of the correction transmitting spring 390 are constituted to be projected to the inner side of the center hole 281*d* of the first corrector setting transmission wheel 281. Since the base portion 390*b* of the correction transmitting spring 390 is elastically deformable, when a force directed to an outer side is exerted to the first key portion 390*d* of the correction transmitting spring 390, the first key portion 390*d* can be widened to the outer side in the radius direction. When the force is stopped to be exerted to the first key portion 390*d* of the correction transmitting spring 390, since the base portion 390*b* of the correction transmitting spring 390 is elastically deformable, the first key portion 390*d* is constituted to be able to return to an initial position. Similarly, when the force directed to the outer side is exerted to the second key portion 390*g* of the correction transmitting spring 390, the second key portion 390*g* can be widened to the outer side in the radius direction. Further, when the force is stopped to be exerted to the second key portion 390*g* of the correction transmitting spring 390, the second key portion 390*g* is constituted to be able to return to an initial position.

When the correction transmitting spring 390 is used, the hand setting stem needs to be provided with an even number of two or more of pieces of the key grooves 118*k* at the correction transmitting portion 118*d* (refer to FIG. 7). It is preferable that a number of the key grooves 118*k* is 4 pieces or 6 pieces or 8 pieces. According to the constitution, it is necessary to arrange an even number of pieces of the key grooves 118*k* at equal intervals (angular intervals to constitute an equal angle) at the outer peripheral portion of the correction transmitting portion 118*d*. A dimension and a shape of the key groove 118*k* of the hand setting stem 118 are set to be able to receive the first key portion 390*d* and the second key portion 390*g* of the correction transmitting spring 280. By providing a plurality of key portions at the correction transmitting spring 280, the correction transmitting spring 390 and the first corrector setting transmission wheel 281 can cooperatively be moved firmly. Further, by the constitution, the correction transmitting spring 390 and the hand setting stem can cooperatively be moved firmly.

(3) Third Embodiment

Next, a third embodiment of a timepiece having a display correcting mechanism of the invention will be explained. In the following explanation, a description will mainly be given of a point of differing the third embodiment of the timepiece having a display correcting mechanism of the invention from the first embodiment of the timepiece having the display correcting mechanism of the invention. Therefore, the above-described explanation of the first embodiment of the timepiece having the display correcting mechanism of the invention will be applied to a portion which is not described in the following. A characteristic of the third embodiment of the timepiece having a display correcting mechanism of the invention resides in a timepiece having a day and date display which is not provided with a mainspring winding state display mechanism but provided with a date indicator and a date correcting mechanism and a day indicator and a day correcting mechanism.

(3-1) Date Feeding Mechanism

Figure 14:
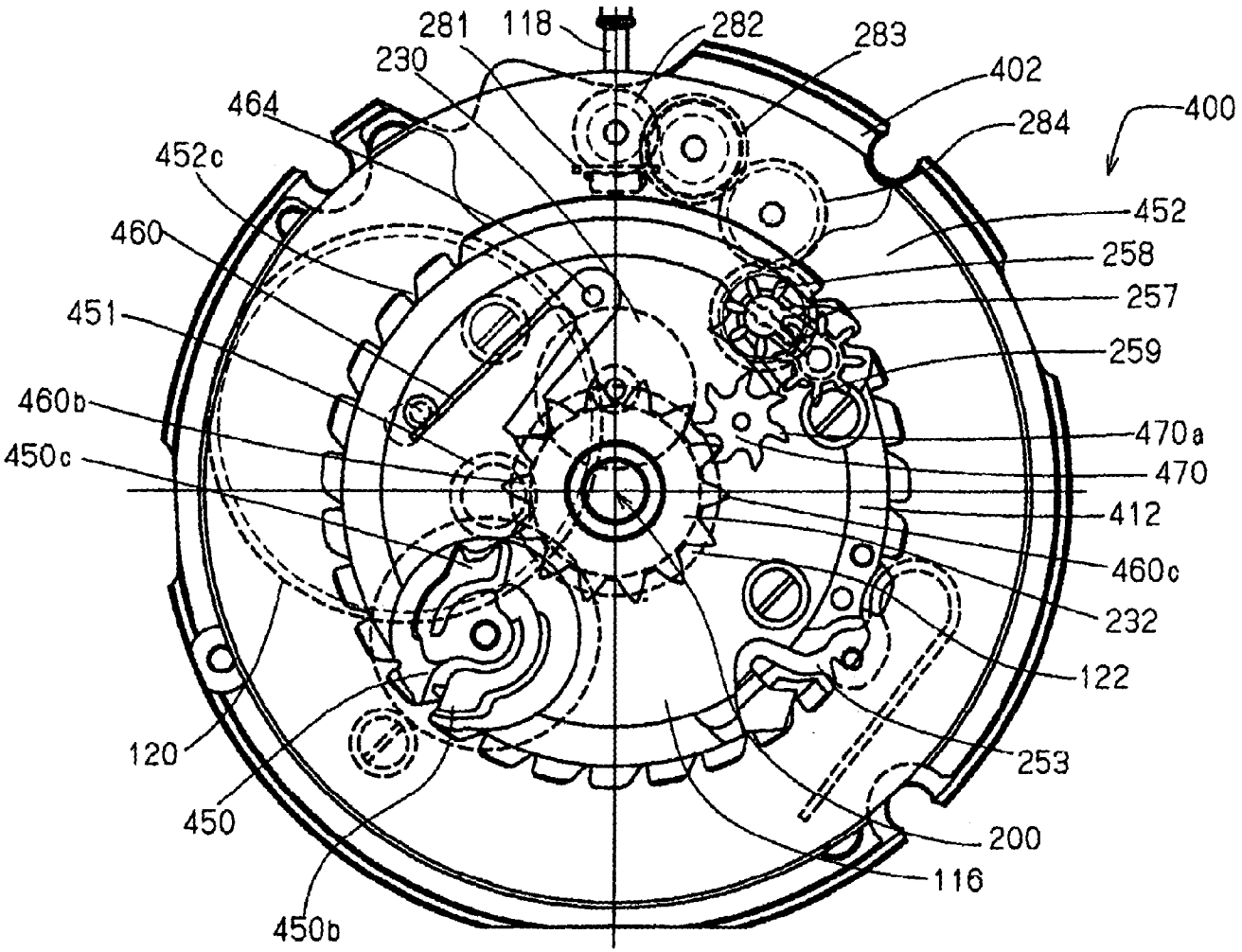
FIG. 14 is a plane view (back plane view) showing a state of viewing a movement from a dial side when a date indicator is corrected according to a third embodiment of a timepiece having a display correcting mechanism of the invention.

In reference to FIG. 14, according to the third embodiment of the timepiece having a display correcting mechanism of the invention, a movement 400 includes a date indicator 452, a date feeding mechanism, a date correcting mechanism, a day indicator 460, a day feeding mechanism and a day correcting mechanism. The date feeding mechanism includes a date indicator driving wheel 450, an intermediate date indicator driving wheel 451 and a date indicator 452. A character (not illustrated) representing date is provided at a date display face of the date indicator 452. The date indicator 452 includes 31 pieces of tooth portions 452*c*. The intermediate date indicator driving wheel 451 is constituted to be rotated by rotation of the hour wheel 232. The date indicator driving wheel 450 is constituted to be rotated by rotation of the intermediate date indicator driving wheel 451. A date feeding claw 450*b* is provided at the date indicator driving wheel 450. When the date indicator driving wheel 450 is rotated, the date indicator 452 is constituted to be rotated by (1/31) once per day by the date feeding claw 450*b* provided at the date indicator driving wheel 450. The date indicator 452 is constituted to be rotated by one rotation per 31 days. A position in a rotational direction of the date indicator 452 is rectified by the date jumper 253.

(3-2) Date Correcting Mechanism

As described above, the date correcting mechanism includes the first corrector setting transmission wheel 281, the second corrector setting transmission wheel 282, the third corrector setting transmission wheel 283, the fourth corrector setting transmission wheel 284, the fifth corrector setting transmission wheel 258 and the corrector setting wheel 259. In the state of drawing out the hand setting stem 118 from 0 stage to 1 stage, when the hand setting stem 118 is rotated in the first direction, the first corrector setting transmission wheel 281 is rotated. The third corrector setting transmission wheel 283 is rotated by rotation of the first corrector setting transmission wheel 281 via rotation of the second corrector setting transmission wheel 282. The fourth corrector setting transmission wheel 284 is rotated by rotation of the third corrector setting transmission wheel 283. The fifth corrector setting transmission wheel 258 is rotated by rotation of the fourth corrector setting transmission wheel 284. As described above, a shaft portion (not illustrated) of the corrector setting wheel 259 is integrated to the fork portion of the pivoting lever 257 rotatably provided to a shaft portion (not illustrated) of the fifth corrector setting transmission wheel 258. By an elastic force directed to an inner side of the fork portion, the corrector setting wheel 259 is constituted to be able to rotate at a position at which the corrector setting wheel 259 is pivoted to stop. The corrector setting wheel 259 is pivoted by a constant angle relative to the second main plate 112 and is supported thereby rotatably at a pivoted position. A rotational center of the corrector setting wheel 259 is arranged on the inner side of the tooth tip circle of the date indicator 252. When the fifth corrector setting transmission wheel 258 is rotated, the corrector setting wheel 259 is pivoted in the first direction of being proximate to a gear portion 452*c* of the date indicator 452 and is stopped at a first position at which a gear portion of the corrector setting wheel 259 is brought in mesh with the gear portion 452*c* of the date indicator 452. When the hand setting stem 118 is rotated further in the first direction under the state, the corrector setting wheel 259 is rotated at the first position and the date indicator 252 is constituted to be able to be rotated. A pivoting range of the corrector setting wheel 259 is determined by a pivoting guide hole (not illustrated) provided at the main plate.

(3-3) Day Feeding Mechanism

Figure 15:
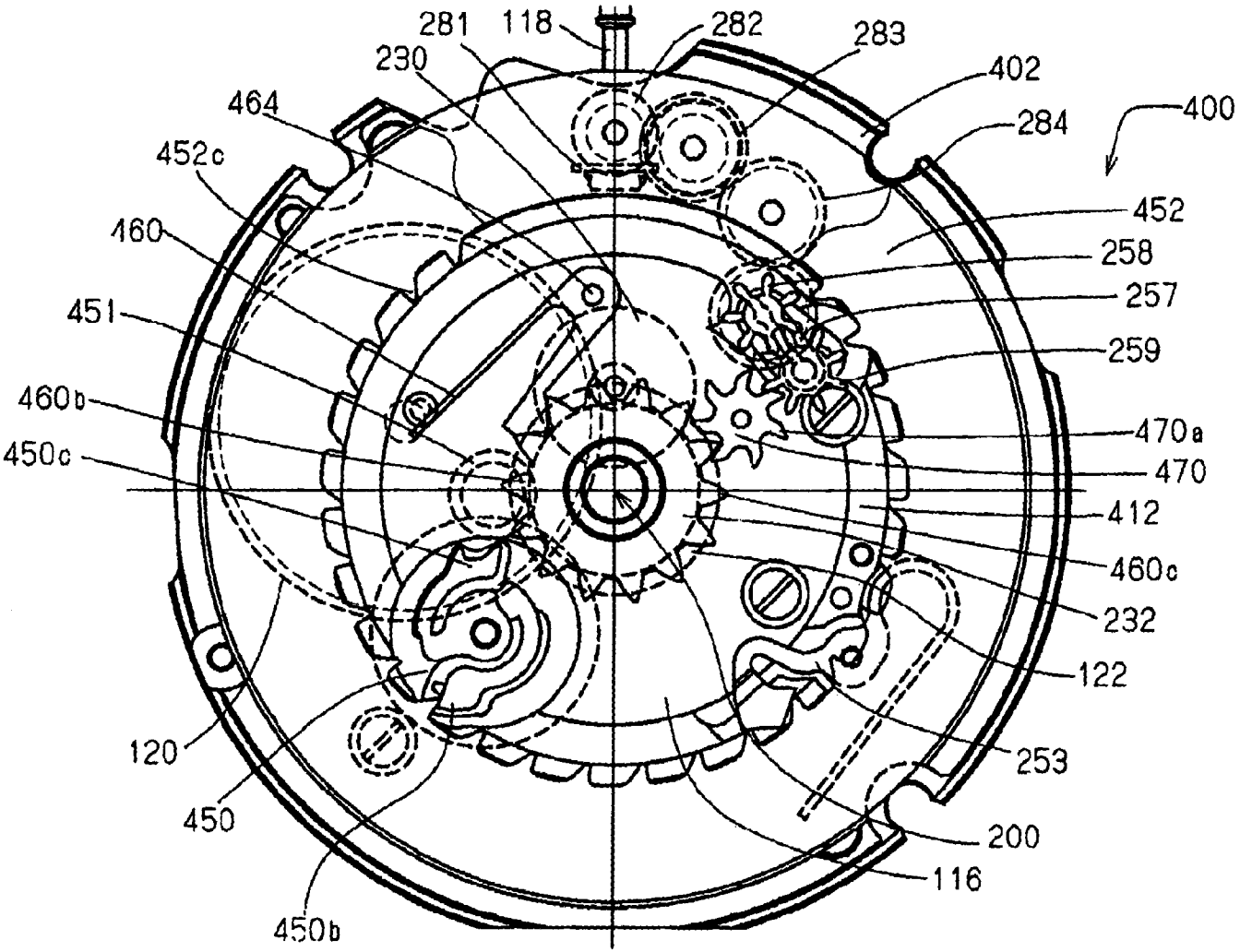
FIG. 15 is a plane view (back plane view) showing a state of viewing the movement from the dial side when a day indicator is corrected according to the third embodiment of the timepiece having the display correcting mechanism of the invention.

In reference to FIG. 14, FIG. 15, a day feeding mechanism includes the date indicator driving wheel 450, the intermediate date indicator driving wheel 451 and a day indicator 460. The day indicator 460 includes a day star wheel 460*b* and a day plate (not illustrated). A character (not illustrated) representing day of week is provided at a day display face of the day plate (not illustrated). The day star wheel 460*b* includes 14 pieces of tooth portions 460*c*. A day feeding claw 450*c* is provided at the date indicator driving wheel 450. When the date indicator driving wheel 450 is rotated by the day feeding claw 450*c*, the day indicator 460 is constituted to be rotated by (1/7) once per day. The day indicator 460 is constituted to be rotated by one rotation per 7 days. A position in a rotational direction of the day indicator 460 is rectified by a day jumper 464. A character (not illustrated) representing day of week provided at the day plate (not illustrated) of the day indicator 460 is constituted to display "day" from a window (not illustrated) of the dial.

(3-4) Day Indicator Correcting Mechanism

A day correcting mechanism is constituted to operate by operating parts constituting the above-described date indicator correcting mechanism. The day correcting mechanism includes a day corrector setting wheel 470 rotatably arranged at a second main plate 412. The day corrector setting wheel 470 includes a day corrector setting gear 470*a*. The day corrector setting gear 470*a* is arranged to be brought in mesh with the day star wheel 460*b*. A day corrector setting transmission gear 470*b* is constituted to be able to be brought in mesh with the corrector setting wheel 259 by being pivoted in a direction of separating from the gear portion of the date indicator 252. In a state of drawing out the hand setting stem 118 from 0 stage to 1 stage, when the hand setting stem 118 is rotated in a second direction different from the first direction, the first corrector setting transmission wheel 281 is rotated. By rotation of the first corrector setting transmission wheel 281, the third corrector setting transmission wheel 283 is rotated via rotation of the second corrector setting transmission wheel 282. By rotation of the third corrector setting transmission wheel 283, the fourth corrector setting transmission wheel 284 is rotated. By rotation of the fourth corrector setting transmission wheel 284, the fifth corrector setting transmission wheel 258 is rotated. When the fifth corrector setting transmission wheel 258 is rotated, the corrector setting wheel 259 is rotated in the second direction of separating from the tooth portion 452*c* of the date indicator 452 and a gear portion of the corrector setting wheel 259 is stopped at a second position of being brought in mesh with the day corrector setting transmission gear 470*b*. When the hand setting stem 118 is rotated further in the second direction under the state, the corrector setting wheel 259 is rotated at the first position and the day corrector setting transmission gear 470*b* is constituted to be able to be rotated. When the day corrector setting wheel 470 is rotated, the day corrector setting gear 470*a* is constituted to be able to rotate the day star wheel 460*b*. By the constitution, the timepiece having the display correcting mechanism capable of firmly carrying out date correction and day correction and having excellent durability of parts constituting the correcting mechanism can be realized.

(4) Fourth Embodiment

Next, a fourth embodiment of a timepiece having a display correcting mechanism of the invention will be explained. In the following explanation, a description will mainly be given of a point of differing the fourth embodiment of the timepiece having a display correcting mechanism of the invention from the third embodiment of the timepiece having the display correcting mechanism of the invention. Therefore, the above-described explanation of the third embodiment of the timepiece having the display correcting mechanism of the invention will be applied to a portion which is not described in the following. A characteristic of the fourth embodiment of the timepiece having a display correcting mechanism of the invention resides in an analog electronic timepiece having a day and date display provided with a date indicator and a date correcting mechanism and a day indicator and a day correcting mechanism. Here, in the fourth embodiment of the timepiece having a display correcting mechanism of the invention, constitutions and operation of a date indicator and a date correcting mechanism and a day indicator and a day correcting mechanism are the same as constitutions and operation of those of the third embodiment of the timepiece having the display correcting mechanism of the invention. Therefore, it is omitted to duplicatedly describe constitutions and operation thereof in the following.

Figure 16:
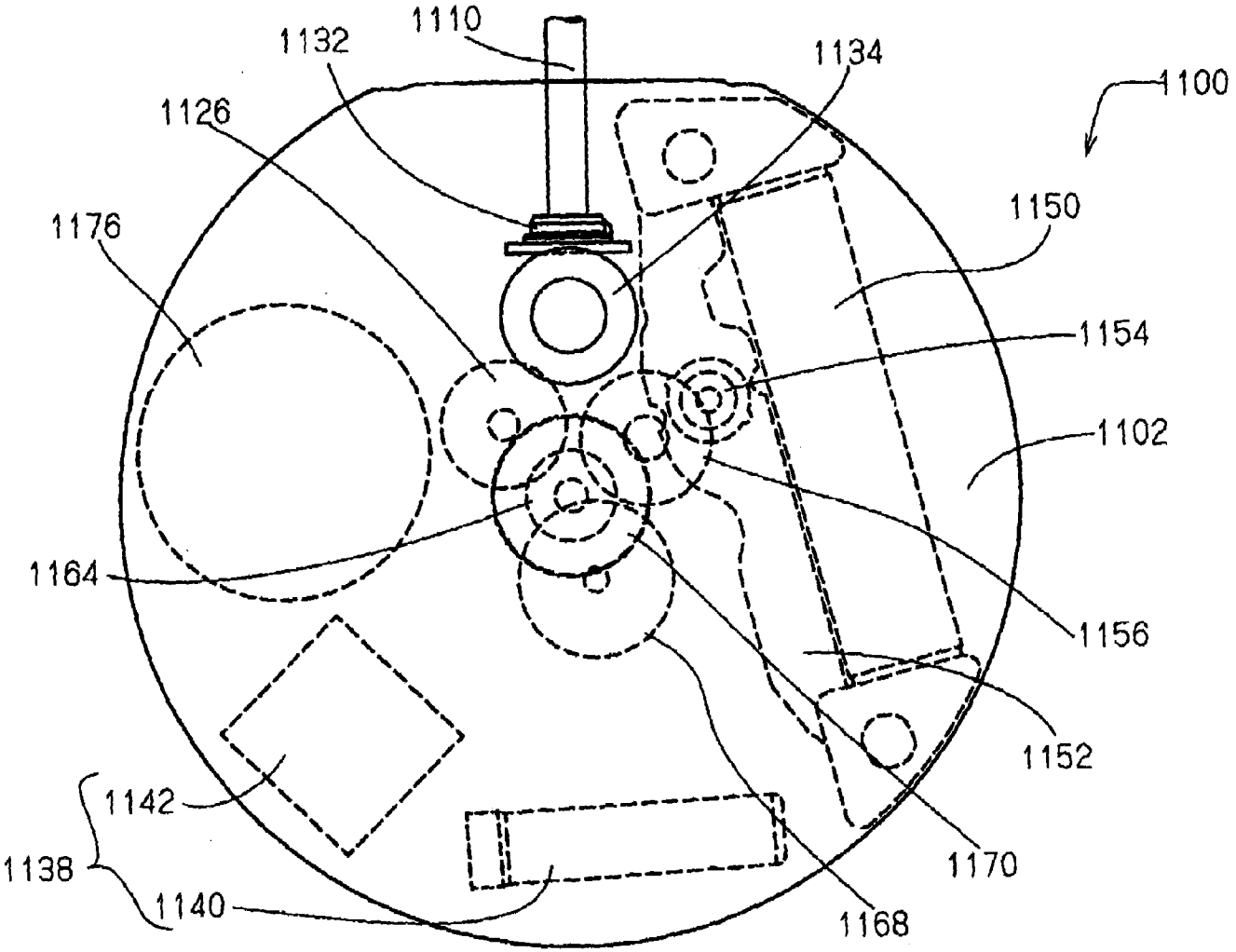
FIG. 16 is a plane view (back plane view) showing a state of a part arranged on a top side of a movement when the movement is viewed from a dial side according to a fourth embodiment of a timepiece having a display correcting mechanism of the invention.

In reference to FIG. 16, in a movement 1100 of a timepiece having a display correcting mechanism, a battery 1176 constituting a power source of a timepiece is arranged on a case back side of a main plate 1102. A quartz unit 1140 constituting an oscillating source of the timepiece is arranged on the case back side of the main plate 1102. For example, a quartz oscillator oscillating at 32,768 Hz is contained in the quartz unit 1140. An oscillating portion (oscillator) outputting a reference signal based on oscillation of the quartz oscillator, a dividing portion (divider) for dividing an output signal of the oscillating portion, and a driving portion (driver) for outputting a motor driving signal for driving a step motor based on an output signal of the dividing portion are included in an integrated circuit (IC) 1142. The integrated circuit (IC) 1142 is constituted by, for example, C-MOS or PLA. When the integrated circuit (IC) 1142 is constituted by C-MOS, the oscillating portion, the dividing portion and the driving portion are included in the integrated circuit 1142. When the integrated circuit (IC) 1142 is constituted by PLA, the oscillating portion, the dividing portion and the driving portion are constituted to be operated by programs stored to PLA.

The quartz unit 1140 and the integrated circuit 1142 are fixed to a circuit board (not illustrated). The circuit board, the quarts unit 1140 and the integrated circuit 1142 constitute a circuit block 1138. The circuit block 1138 is arranged on the case back side of the main plate 1102. A coil block 1150 including a coil wire wound around a magnetic core, a stator 1152 arranged to be brought into contact with both end portions of the magnetic core of the coil block 1150, and a rotor 1154 including a rotor magnet arranged at a rotor hole of the stator 1152 are arranged on the case back side of the main plate 1102. The coil block 1150, the stator 1152 and the rotor 1154 constitute a step motor. A fifth wheel & pinion 1156 rotated based on rotation of the rotor 1154 is arranged on the case back side of the main plate 1102. A second wheel & pinion 1164 rotated based on rotation of the fifth wheel & pinion 1156 is arranged on the case back side of the main plate 1102. The second wheel & pinion 1164 is constituted to rotate by one rotation per minute. A second hand is attached to the second wheel & pinion 1164.

A third wheel & pinion 1168 rotated based on rotation of the second wheel & pinion 1164 is arranged on the case back side of the main plate 1102. A center wheel & pinion 1170 rotated based on rotation of the third wheel & pinion 1168 is arranged on the case back side of the main plate 1102. A minute hand is attached to the center wheel & pinion 1170. A slip mechanism is provided at the center wheel &pinion 1170. When hand setting is carried out by the slip mechanism, in a state of stopping a second hand, by rotating a hand setting stem 1110, the minute hand and the hour hand can be rotated. In carrying out hand setting, in order to stop the second hand by rectifying the second wheel & pinion 1164 or the fifth wheel & pinion 1156, a train wheel setting lever (not illustrated) is provided. The center wheel & pinion 1170 is constituted to rotate by one rotation per hour. A minute wheel 1126 rotated based on rotation of the center wheel & pinion 1170 is arranged on the case back side of the main plate 1102. The hour wheel 232 (refer to FIG. 14) is arranged on a dial side of the main plate 1102 to rotate based on rotation of the minute hand 1126. The intermediate date indicator driving wheel 451 is constituted to rotate by rotation of the hour wheel 232.

Operation of the fourth embodiment of the timepiece having the display correcting mechanism of the invention will be explained. In the movement 1100 of the timepiece having the display correcting mechanism, the quartz oscillator contained in the quartz unit 1140 is oscillated by, for example, 32,768 Hz. Based on oscillation of the quartz oscillator, the oscillating portion included in the integrated circuit 1142 outputs the reference signal, and the dividing portion divides the output signal of the oscillating portion. The driving portion outputs the motor driving signal for driving the step motor based on the output signal of the dividing portion. When the coil block 1150 inputs the motor driving signal, the stator 1152 is magnetized to rotate the rotor 1154. The rotor 1154 is rotated, for example, by 180 degrees per second. Based on rotation of the rotor 1154, the second wheel & pinion 1164 is rotated by one rotation per minute via rotation of the fifth wheel & pinion 1156. The third wheel & pinion 1168 is rotated based on rotation of the second wheel & pinion 1164. The center wheel & pinion 1170 is rotated by one rotation per hour based on rotation of the third wheel & pinion 1168. The minute wheel 1126 is rotated based on rotation of the center wheel & pinion 1170. The hour wheel 232 is rotated based on rotation of the minute wheel 1126. The hour wheel 232 is rotated by on rotation per 12 hours. By rotation of the hour wheel 232, the intermediate date indicator driving wheel 451 is rotated. By rotation of the intermediate date indicator driving wheel 451, the date indicator driving wheel 450 is rotated. By the date feeding claw 450*b* provided at the date indicator driving wheel 450, the date indicator 452 is rotated by (1/31) once per day. The date indicator 452 is constituted to be rotated by one rotation per 31 days. By the day feeding claw 450*c* provided at the date indicator driving wheel 450, the day indicator 460 is rotated by (1/7) once per day. The day indicator 460 is rotated by one rotation per 7 days.

The invention provides the timepiece having the display correcting mechanism promoting a durability of a part constituting the display correcting mechanism. Further, the invention provides the timepiece having the display correcting mechanism simplifying a structure of a part constituting the display correcting mechanism. The calendar correcting mechanism of the invention is widely applicable to various timepieces having display correcting mechanisms including not only the mechanism of correcting the date indicator but also mechanisms of correcting a day display wheel, a day indicator, a 24 hour display wheel, a month display wheel, a lunar age display wheel and the like, an hour correcting mechanism and the like. The display correcting mechanism of the invention is widely applicable also to a mechanical timepiece, an electric timepiece and an analog electronic timepiece.

According to the timepiece having the display correcting mechanism of the invention, a square portion of the hand setting is not brought in and out to and from a hole portion of the corrector setting wheel formed by the plastic and therefore, there is not a concern of wearing the hole portion of the corrector setting indicator and a durability of a part constituting the correcting mechanism can be promoted. Further, according to the timepiece having the display correcting mechanism of the invention, a structure of a part constituting the correcting mechanism is simple and it is easy to cooperatively move a winding pinion and a clutch wheel.

What is claimed is:

1. A timepiece having a display correcting mechanism for correcting a display content displayed by a display member, the timepiece comprising:

a train wheel;

a display member mounted for undergoing rotation in accordance with rotation of the train wheel for displaying information;

a hand setting stem for correcting a display content of the display member;

a corrector setting transmission wheel arranged coaxially with the hand setting stem;

a correction transmitting spring formed of an elastic material and mounted for undergoing movement with the corrector setting transmission wheel; and a correcting member for undergoing operation in accordance with rotation of the corrector setting transmission wheel and the correction transmitting spring for correcting the display content of the display member;

wherein the display content displayed by the display member is corrected by operating the correcting member by integrally rotating the corrector setting transmission wheel and the correction transmitting spring by rotating the hand setting stem in a state of setting the hand setting stem to a position for correcting the display content of the display member, wherein the hand setting stem has at least one key groove and the correction transmitting spring has a key portion for engaging the key groove so that the corrector setting transmission wheel and the correction transmitting spring are integrally rotated when the hand setting stem is rotated while the key portion engages the key groove in the state of setting the hand setting stem to the position for correcting the display content of the display member, and wherein in a state of setting the hand setting stem to a position other than the position for correcting the display content of the display member, the key portion of the correction transmitting spring is not brought into engagement with the key groove of the hand setting stem so that the corrector setting transmission wheel and the correction transmitting spring are not rotated even when the hand setting stem is rotated.

2. A timepiece having a display correcting mechanism according to claim 1; wherein the at least one key groove comprises a plurality of key grooves arranged at equal intervals at an outer peripheral portion of the hand setting stem.

3. A timepiece having a display correcting mechanism according to claim 1; wherein the correction transmitting spring includes a generally C-shaped base portion and a positioning portion formed orthogonally to one end portion of the base portion, the key portion being disposed at a front end of the positioning portion.

4. A timepiece having a display correcting mechanism according to claim 1; wherein the corrector setting transmission wheel has a generally ring-shaped main body cylinder portion, a plurality of tooth portions, a center hole provided at the main body cylinder portion, a generally ring-shaped band portion disposed at one surface of the main body cylinder portion, and a groove portion formed in the band portion.

5. A timepiece having a display correcting mechanism according to claim 4; wherein the corrector setting transmission wheel comprises a first corrector setting transmission wheel; and further comprising a second corrector setting transmission wheel for meshing engagement with the first corrector setting transmission wheel and arranged to overlap a center axis line of the hand setting stem.

6. A timepiece having a display correcting mechanism according to claim 5; wherein the display member comprises a date indicator; and wherein a rotational center of the second corrector setting transmission wheel is arranged on an outer side of a tooth tip circle of the date indicator.

7. A timepiece having a display correcting mechanism according to claim 6; further comprising an indicator for displaying information different from the display content of the display member; and wherein a rotational center of the indicator is arranged on an inner side of the tooth tip circle of the date indicator and the indicator is arranged to overlap the center axis line of the hand setting stem.

8. A timepiece having a display correcting mechanism according to claim 1; wherein the display member comprises a date indicator for displaying date information.

9. A timepiece having a display correcting mechanism according to claim 1; further comprising a day display wheel; and wherein the display member comprises a day indicator connected to the day display wheel for displaying day information.

* * * * *